US006719393B2

(12) United States Patent
Uchida

(10) Patent No.: US 6,719,393 B2
(45) Date of Patent: Apr. 13, 2004

(54) INK JET RECORDING APPARATUS

(75) Inventor: Kota Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/214,607

(22) Filed: Aug. 9, 2002

(65) Prior Publication Data

US 2003/0030692 A1 Feb. 13, 2003

(30) Foreign Application Priority Data

Aug. 10, 2001 (JP) ..... 2001-243647

(51) Int. Cl.[7] ..... B41J 29/38; B41J 2/15; B41J 2/145; B41J 2/01

(52) U.S. Cl. ..... 347/16; 347/104; 347/40

(58) Field of Search ..... 347/16, 104, 40, 347/12

(56) References Cited

U.S. PATENT DOCUMENTS 5,051,761 A * 9/1991 Fisher et al. ..... 347/33
6,239,817 B1 * 5/2001 Meyer ..... 347/36
6,293,669 B1 9/2001 Uchida ..... 347/104
6,390,577 B1 * 5/2002 Fajour ..... 347/2

* cited by examiner

*Primary Examiner*—Thinh Nguyen
(74) *Attorney, Agent, or Firm*—Fitzpatrick, Cella, Harper & Scinto

(57) ABSTRACT

An ink jet recording apparatus comprises a head mounting unit for mounting a first recording head having a nozzle row in which a plurality of nozzles are arranged in a predetermined direction to eject out ink from at least some of the nozzles of the nozzle row in order to perform recording on a recording sheet conveyed in the predetermined direction, and a platen arranged opposite to the head mounting unit, for regulating a position of the recording sheet. The first recording head can be replaced by a second recording head which is different therefrom in position or length of the nozzle row in the predetermined direction, and the platen has a preliminary ejection outlet common in use to the first and second recording heads, for guiding the ink ejected out from some of the nozzles of the nozzle row. Therefore, the preliminary ejection outlet provided on the platen can be commonly used for various recording heads having different nozzle lengths and positions, hence reducing manufacturing costs owing to the common utilization of the platen parts.

7 Claims, 21 Drawing Sheets

INK JET RECORDING APPARATUS

BACKGROUND OF THE INVENTION

1. Field of the Invention

The present invention relates to an ink jet recording apparatus and, more particularly, to an ink jet recording apparatus provided with a function to perform such recording as to eliminate both top and bottom blank portions of a recording material.

Note here that in the following description a term "record" ("print" in some cases) is supposed to mean generally forming an image, a design, a pattern, etc. on a printing medium or processing the medium irrespective of whether significant information such as a character or a graphic or insignificant information is made up and also irrespective of whether the information is so visualized as to be perceptible to a human with the sense of sight.

Furthermore, a "recording sheet" as a recording medium is supposed to mean not only a paper used in a typical printer but also a wide variety of media capable of receiving ink such as a cloth, a plastic film, glass, a ceramic member, wood, leather, etc.

Furthermore, "ink" ("liquid" in some cases) should be interpreted broadly as in the case of the above-mentioned definition of the term "record" and, therefore, is supposed to refer to a liquid that can be applied onto a recording sheet so as to form an image, a design, a pattern, etc. or to process the recording sheet or also to treat ink (for example, coagulate or make insoluble, a color material contained in the ink) applied on the recording sheet.

2. Description of the Related Art

FIG. 21 is a schematic configuration diagram of a generic ink jet recording apparatus. This ink jet recording apparatus comprises a sheet feeding section for feeding recording sheets one by one, a conveying section for conveying a recording sheet fed from the sheet feeding section to a recording section, the recording section including a recording head 206 for ejecting ink, in recording, to the recording sheet conveyed by this conveying section, and a sheet discharging section including a sheet discharging roller 207 for discharging the recording sheet conveyed to the recording section to the outside of the apparatus.

The sheet feeding section has a sheet loading portion 200 on which recording sheets 201 are loaded and a sheet feeding roller 202 for separately conveying recording sheets 201 one by one from this sheet loading portion 200. The conveying section has an LF roller 203 for feeding the recording sheet 201 separately conveyed by the sheet feeding roller 202 to the recording section and a platen 204 disposed opposite to the recording head 206 for regulating a position of the recording sheet 201 at a recording position of the recording head 206. The recording head 206 has a row consisting of a plurality of nozzles arranged in a direction in which the recording sheet 201 is conveyed so that these nozzles may eject out ink therefrom.

In this ink jet recording apparatus, the sheet feeding roller 202 rotates to feed out the recording sheets 201 from the sheet loading portion 200 one by one. The thus fed out recording sheet 201 arrives at the LF roller 203 and is regulated at its top or leading edge there and then fed out by the LF roller 203 onto the platen 204. When the top of the recording sheet 201 thus fed out onto the platen 204 arrives at a predetermined position, the recording head 206 starts recording. When it is finished being printed by the recording head 206, the recording sheet 201 reaches the sheet discharging roller 207 and then is discharged out of the apparatus by this sheet discharging roller 207.

In ordinary recording, a blank region is provided at the edges (four sides including the top and bottom) of the recording sheet 201, whereas recently data can be recorded with no blank region as in the case of such printing with no blank region on each of the four sides as to be generally conducted in the service of printing out an image recorded on a photo film.

Such blank-less recording can be implemented by supplying image data having a size a little larger than that of a recording sheet so that the data, when recorded, may overflow slightly from each of the four edges of the recording sheet. If this blank-less recording is performed using such a platen construction as shown in FIG. 21, ink ejected out of the recording sheet sticks to the surface of the platen, thus contaminating the recording sheet To solve this problem of recording sheet contamination, there is proposed such a design that a large hole is provided all over such a region on the platen surface as to be opposite the nozzle row of the recording head. In this case, the dumped extra ink ejected out in top-and-bottom blank-less recording is collected through that hole, thus preventing the ink from sticking to the platen surface.

Besides the above, such a recording apparatus is proposed that a first hole is provided in a portion of the platen surface which is opposite to a part in the downstream side of the nozzle row of the recording head so that this downstream side part may be used to perform top blank-less recording on a recording sheet and a second hole is provided in a portion of the platen surface which is disposed opposite to a part in the upstream side of the nozzle row of the recording head so that this upstream side part may be used to perform bottom blank-less recording on this record material. In this case, the ink dumped in top blank-less and bottom blank-less recording is received through the first and second holes, respectively.

Furthermore, a recording apparatus is proposed such that a central hole is provided in a recording-sheet conveying direction at the center of such a flat top portion of the platen surface as to support a recording sheet so that nozzles of the row which is disposed opposite to this central hole may be used in top-and-bottom blank-less recording on the recording sheet. In this case, the ink dumped in the top-and-bottom blank-less recording is received through the central hole.

The above-mentioned conventional constructions capable of blank-less recording, however, have the following problems.

The construction that has a large hole all over the region on the platen surface opposite the nozzle row of the recording head has a problem of so-called paper jamming occurring when the top of a recording sheet conveyed by the conveying roller hits the wall of the hole. In addition, since the large hole is provided in the platen surface, a reference face to regulate the position of the recording sheet on the platen is restricted in size by that large hole and cannot securely support the recording sheet. This results in a problem of an indefinite distance between the recording head and the recording sheet, thus giving rise to a problem of deterioration in recording quality.

The construction provided with the first and second holes in the platen surface and that provided with the central hole therein both have a smaller size of the holes themselves and so do not suffer from the problem of paper jamming or deterioration in recording quality. A recording apparatus having such construction, however, cannot employ recording heads that are different in position or length of the nozzles in the direction in which the recording sheet is conveyed. To use such a recording head, it is necessary to provide a preliminary ejection outlet in the platen at a different position corresponding to the recording head, so that one more platen must be provided as a different part. Therefore, platen parts cannot commonly be used for the recording heads different in position or length of the nozzles, thus giving rise to a disadvantage in manufacturing costs.

SUMMARY OF THE INVENTION

It is an object of the present invention to provide a low-cost ink jet recording apparatus that can avoid paper jamming and deterioration in recording quality.

It is another object of the present invention to provide an ink jet recording apparatus that comprises head mounting means for mounting thereon a first recording head having a row of nozzles in which a plurality of nozzles are provided in a predetermined direction, to eject ink from at least some of said row of nozzles in order to record data on a recording sheet conveyed in said predetermined direction and a platen arranged opposite to said head mounting means, for regulating a position of said recording sheet, in which said first recording head can be replaced by a second recording head different from said first recording head in position or length in said predetermined direction of said row of nozzles and said platen has such a preliminary ejection outlet common to said first and second recording heads as to guide ink ejected from said part of said row of nozzles.

DESCRIPTION OF THE PREFERRED EMBODIMENTS

The following will describe embodiments of the present invention with reference to drawings. The following embodiments exemplify an ink jet recording type printer (that is, ink jet printer).

[Apparatus Body]

Figure 2:
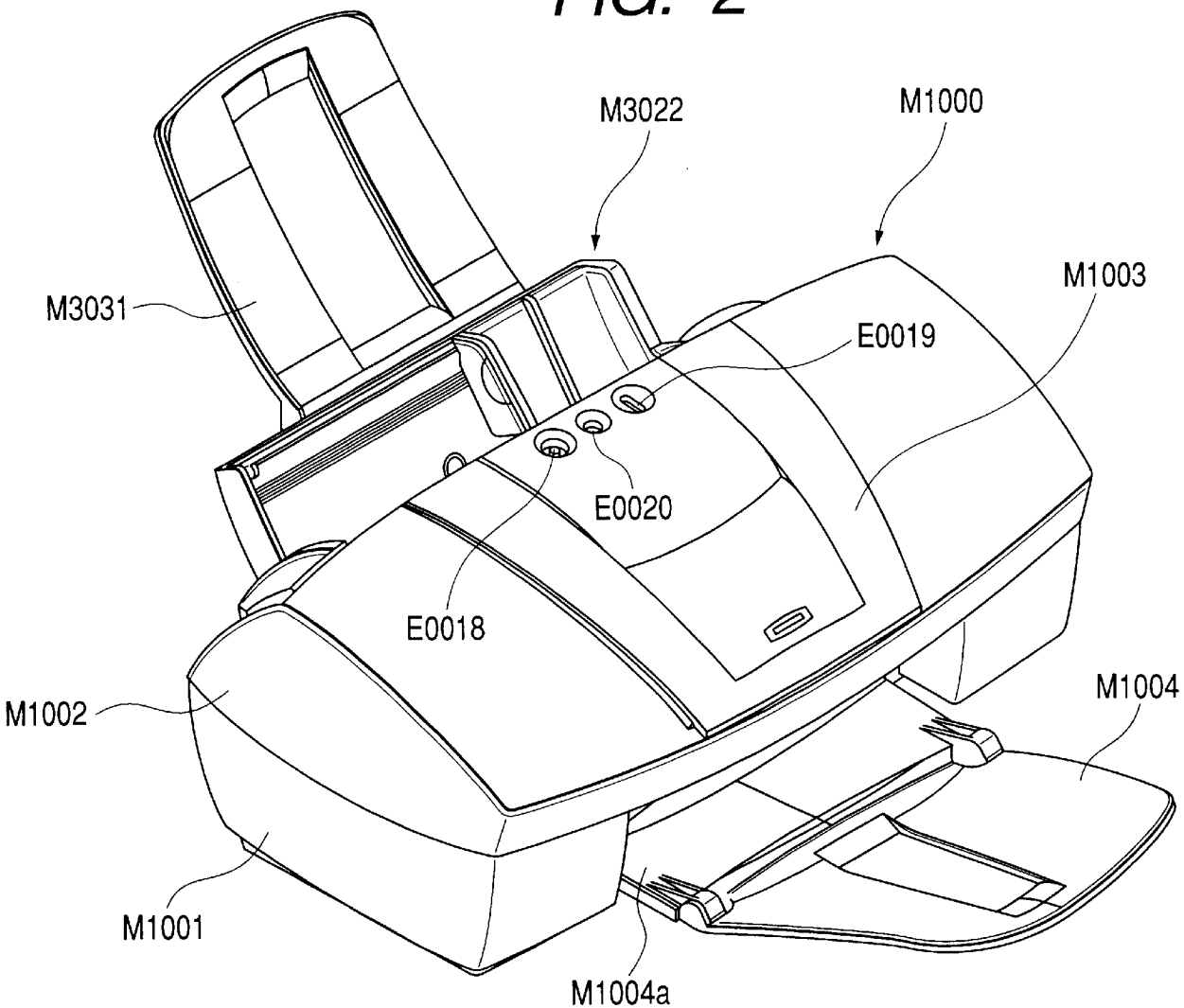
FIG. 2 is an external view for showing the ink jet printer of FIG. 1.
Figure 3:
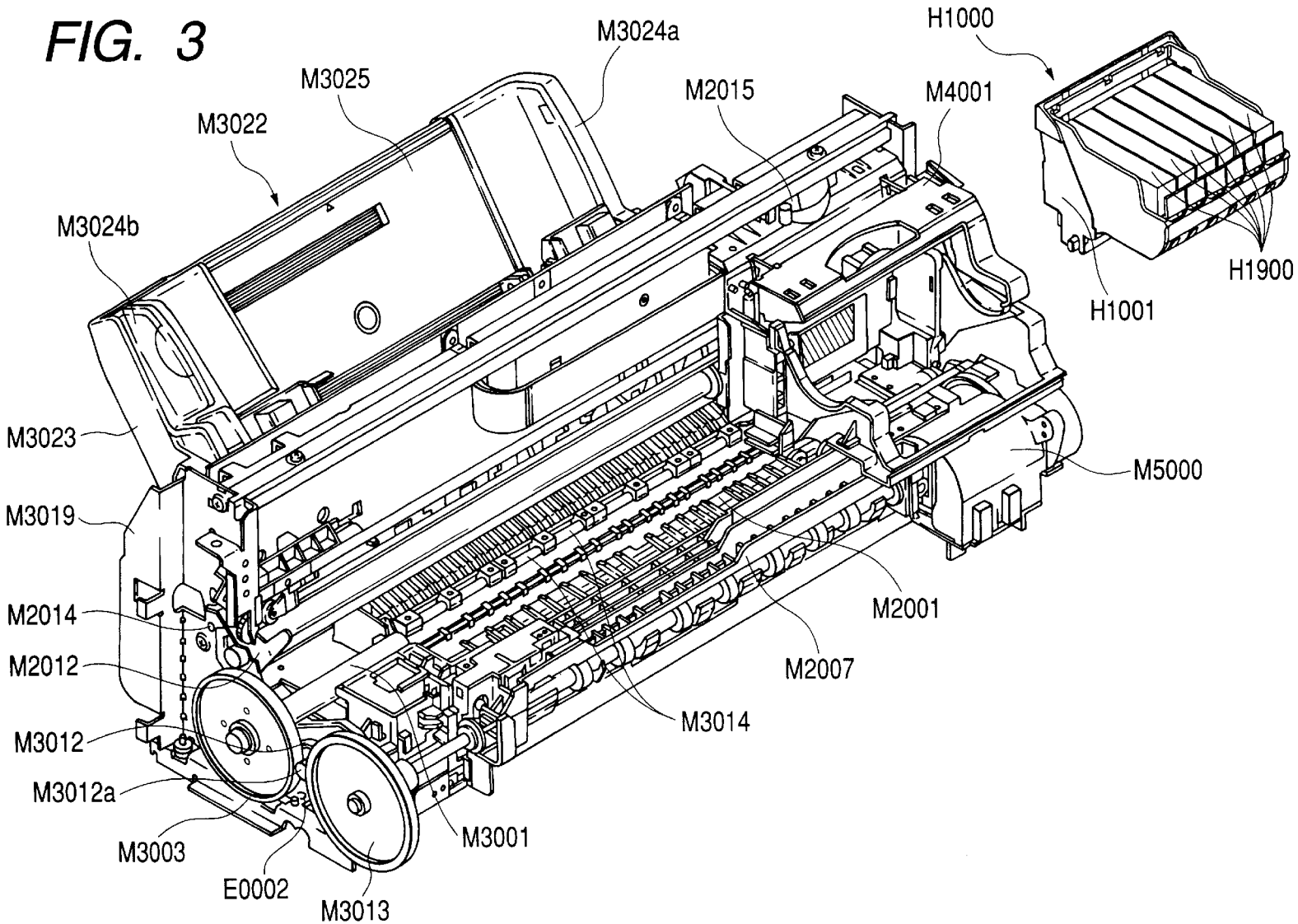
FIG. 3 is a perspective view for showing a state where outer packaging members of the ink jet printer shown in FIG. 2 are removed.

FIG. 2 shows an external view of an ink jet printer according to one embodiment of the present invention and FIG. 3 is a perspective view for showing a state where outer housing members of the ink jet printer shown in FIG. 2 are removed.

As shown in FIGS. 2 and 3, an apparatus body M1000 which provides an outer sheathing of the ink jet printer comprises such outer packaging members as a lower case M1001, an upper case M1002, an access cover M1003, and a discharging tray M1004 and a chassis M3019 housed in these outer packaging members.

The chassis M3019 is comprised of a plurality of plate-shaped metal members having predetermined rigidity to form a printer skeleton, thus holding later-described various recording mechanisms. The lower case M1001 forms roughly the lower half of the apparatus body M1000, while the upper case M1002 forms roughly the upper half thereof, which are combined to provide a hollow construction having a space for housing the later-described various mechanisms therein with openings formed in its top face and front face respectively.

The discharging tray M1004 has its one end held in a rotary manner to the upper case M1002, while another discharging tray **M1004*a* is provided to the lower case M1001** detachably.

The access cover M1003 has its one end held in a rotary manner to the upper case M1002 and has an opening capable of being opened/closed formed in its right face. By opening this access cover M1003, it is possible to replace a recording head, an ink tank, etc. housed in the printer. Note here that although not shown, when the access cover M1003 is opened/closed, a protrusion formed on its back face causes a cover opening/closing lever to rotate, a rotation position of which can be detected by a micro-switch, etc., thus detecting the opened/closed state of the access cover.

At the rear part on the right face of the upper case M1002 are provided a power source key E0018 and a resumption key E0019 which can be pressed, as well as an LED E0020, so that when the power source key E0018 is pressed, the LED E0020 lights up, thus notifying an operator that recording is possible. Furthermore, the LED E0020 has a variety of display functions to change a blinking manner or a display color in order to notify the operator of a printer trouble, for example. Note here that when the trouble, etc. is solved, the resumption key E019 can be pressed to resume printing.

[Recording Mechanism]

Figure 1:
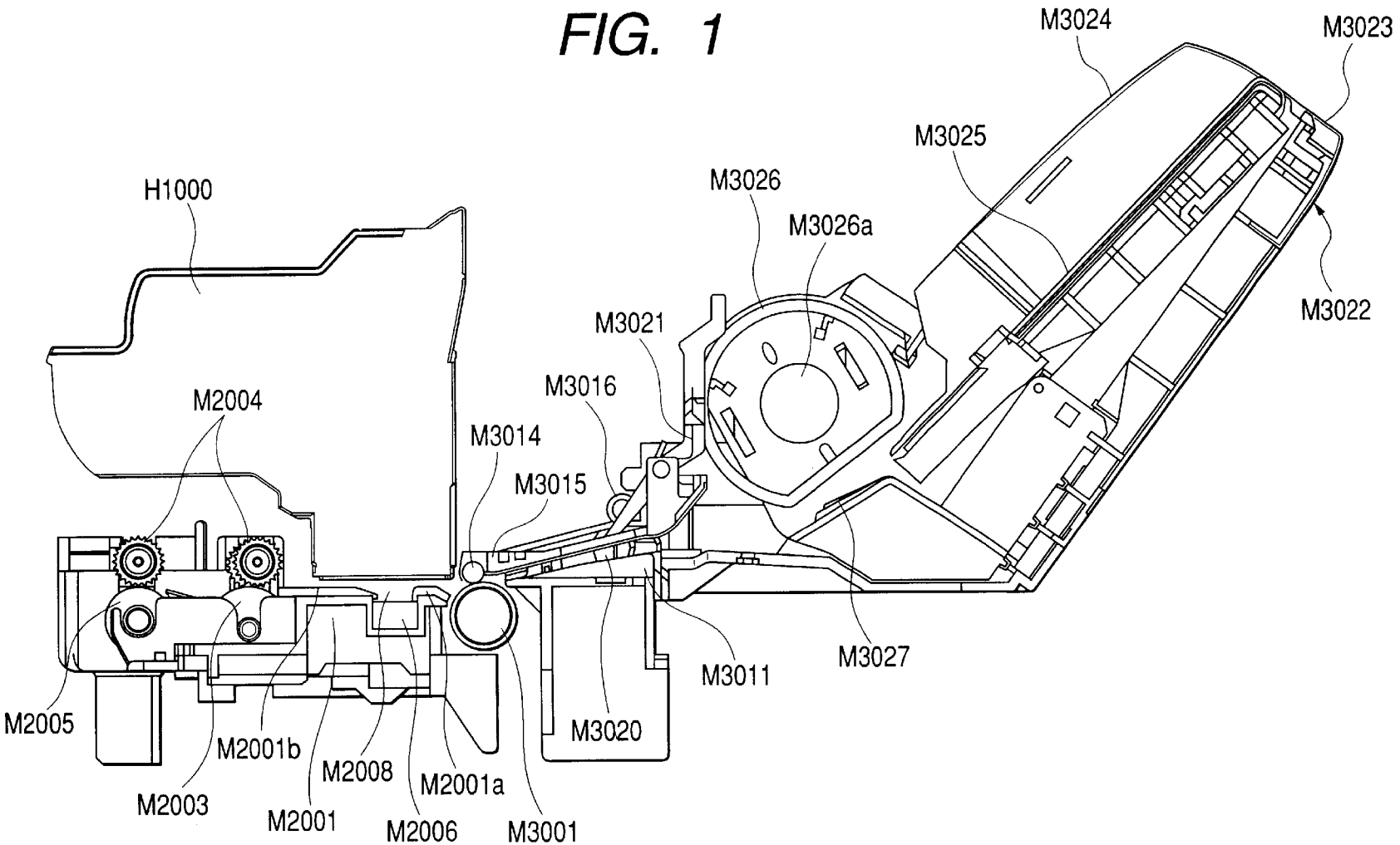
FIG. 1 is a side view for showing an internal construction of an ink jet printer according to one embodiment of the present invention.

The following will describe a recording mechanism housed and held in the above-mentioned apparatus body M1000. FIG. 1 is a schematic side view for showing an internal construction of the inkjet printer shown in FIGS. 1 and 2. The description is made with reference to FIGS. 1 and 3 below.

This recording mechanism is comprised of an automatic feeding section M3022 for automatically feeding a recording sheet P into the apparatus body, a conveying section M3029 for guiding the recording sheets P fed out one by one from the automatic feeding section to a desired recording position and also guiding them from the recording position to a sheet discharging section M3030, a recording section M4000 for performing desired recording on the recording sheets P conveyed to the conveying section M3029, and a recovery section M5000 for recovering said recording section M4000, etc.

The following will describe a specific configuration of these mechanism components.

(Automatic Feeding Section)

The automatic feeding section M3022 feeds the recording sheets P loaded while being inclined by about 30–60 degrees with respect to the horizontal face and discharges them roughly horizontally from a feeding outlet, not shown, into the apparatus body, being comprised of a feeding roller M3026, a movable side guide M3024, a pressure plate M3025, an ASF base M3023, a separation pad M3027, etc. as shown in FIGS. 1 and 3.

The ASF base M3023 roughly forms an outer sheath of the automatic feeding section M3022 and is provided on the rear side of the apparatus body. On the right side of the ASF base M3023 are attached the pressure plate M3025 inclined by about 30–60 degrees with respect to the horizontal face for supporting the recording sheet P and also a pair of sheet guides M3024*a* and M3024*b* as projected for guiding the recording sheet P by its both edges. One of the sheet guides M3024*b* can be moved horizontally to accommodate a variety of horizontal sizes (widths) of the recording sheet P.

On both sides of the ASF base M3023 is supported a driving shaft M3026*a* which is associated with an ASF motor via a transmission gear row (not shown), to which driving shaft M3026*a* is fixed the plurality of sheet feeding rollers M3026 having a irregular circumferential face shape.

When the feeding rollers M3026 rotate as associated with the driving of the ASF motor, the recording sheets P loaded on the pressure plate M3025 are separated from each other by the separation pad M3027 and fed out one by one starting from the uppermost one to be conveyed to the conveying section M3029.

Note here that since the pressure plate M3025 is supported elastically at its lower end by a pressure plate spring (not shown) interposed between itself and the ASF base M3023, a pressing force exerted between the feeding roller M3026 and the recording sheet P can be held roughly constant irrespective of the number of the recording sheets P loaded.

Furthermore, on a path for conveying the recording sheets P from the automatic feeding section M3022 to the conveying section M3029, a PE lever M3020 energized by a PE lever spring M3021 in a predetermined direction (counterclockwise direction in FIG. 1) is attached axially to a pinch roller holder M3015 supported in a turning manner to the apparatus body M1000, so that when the recording sheet P separated in conveyance from the automatic feeding section M3022 goes along the conveyance path until its top presses one end of the PE lever M3020 and rotates it, a PE sensor (not shown) detects the rotation of the PE lever M3020, thus detecting that the recording sheet P has advanced into the conveyance path.

When the advancing of the recording sheet P into the conveyance path has thus been detected, the recording sheet P is conveyed by the feeding roller M3026 to the downstream side by a predetermined conveyance distance. In this conveyance operation by this feeding roller M3026, the recording sheet is abutted at its top against nip portions of the LF roller M3001 and the pinch roller M3014 provided on the later-described conveying section which are in a stopped state and so stops as flexed by a predetermined amount. This flexure amount (looping magnitude) is, for example, about 3 mm.

(Conveying Section)

As shown in FIGS. 1 and 3, the conveying section M3029 is comprised of the LF roller M3001, the pinch roller M3014, a platen M2001, a platen absorber M2016, etc. The LF roller M3001 is supported to the chassis M3019 in a turning manner by bearings and has an LF gear M3003 fixed to its one end. The LF gear M3003 meshes with a minor gear M3012*a* of an intermediate gear M3012. The LF intermediate gear M3012 meshes with a driving gear provided on a driving shaft of an LF motor E0002 so as to rotate as driven by this LF motor E0002.

The pinch roller M3014 is axially attached to a tip of the pinch holder M3015 supported in a turning manner to the chassis M3019 to be abutted against the LF roller M3001 by a roll spring-shaped pinch roller spring M3016, which energizes the pinch roller holder M3015. When the LF roller M3001 rotates, the pinch roller M3014 rotates correspondingly, to convey the recording sheet P stopped in a loop as described above to the downstream side as sandwiching it between itself and the pinch roller M3014.

The rotation center of the pinch roller M3014 is offset by about 2 mm to the downstream side in the conveying direction with respect to the rotation center of the LF roller M3001. Accordingly, the recording sheet P conveyed as sandwiched between the LF roller M3001 and the pinch roller M3014 is inclined downward to the left in FIG. 1, thus being conveyed along a recording sheet support face M2001*a* of the platen M2001.

In this configuration of the conveying section, when the conveying operation by the sheet feeding roller M3026 of the automatic conveying section M3022 is stopped and a constant time elapses, the LF motor E0002 starts driving, a driving force of which is transmitted to the LF roller M3001 via the LF intermediate gear M3012 and the LF gear M3003. Then, the recording sheet P whose top is abutted against the nip portions of the LF roller M3001 and the pinch roller M3014 is conveyed to the recording start position on the platen M2001 as the LF roller M3001 rotates.

In this conveyance operation, the feeding roller M3026 starts rotating again simultaneously with the LF roller M3001, so that they cooperate with each other for a predetermined time to thereby convey the recording sheet P to the downstream side.

A recording head cartridge H1000 moves together with a carriage M4001 which reciprocates in a direction (main scanning direction) which intersects (for example, at a right angle) with the conveying direction of the recording sheet P along a carriage shaft M4012 whose both ends are fixed by the chassis M3019, to thereby eject out ink onto the recording sheet P standing by at the recording start position, thus recording an ink image based on predetermined image information.

After the ink image is recorded, the recording sheet P is conveyed by a predetermined conveyance distance by means of the rotation of the LF roller M3001, for example, in units of a conveyance line of 5.42 mm and, upon completion of this conveyance operation, the carriage M4001 performs main scanning along the carriage shaft M4012, which operation is repeated to thereby record the ink image on the recording sheet P placed on the platen M2001.

The carriage M4012 has its one end mounted to one inter-paper adjusting plate ®) (not shown) and its the other end mounted to the other inter-paper adjusting plate (L) M2012 as energized via a carriage shaft spring M2014. These inter-paper adjusting plates are fixed to the chassis M3019 as adjusted so as to provide an adequate spacing between the ejection face of the recording head mounted to the recording head cartridge H1000 and recording support faces M2001*a* and M2001*b* of the platen M2001.

(Sheet Discharging Section)

Figure 4:
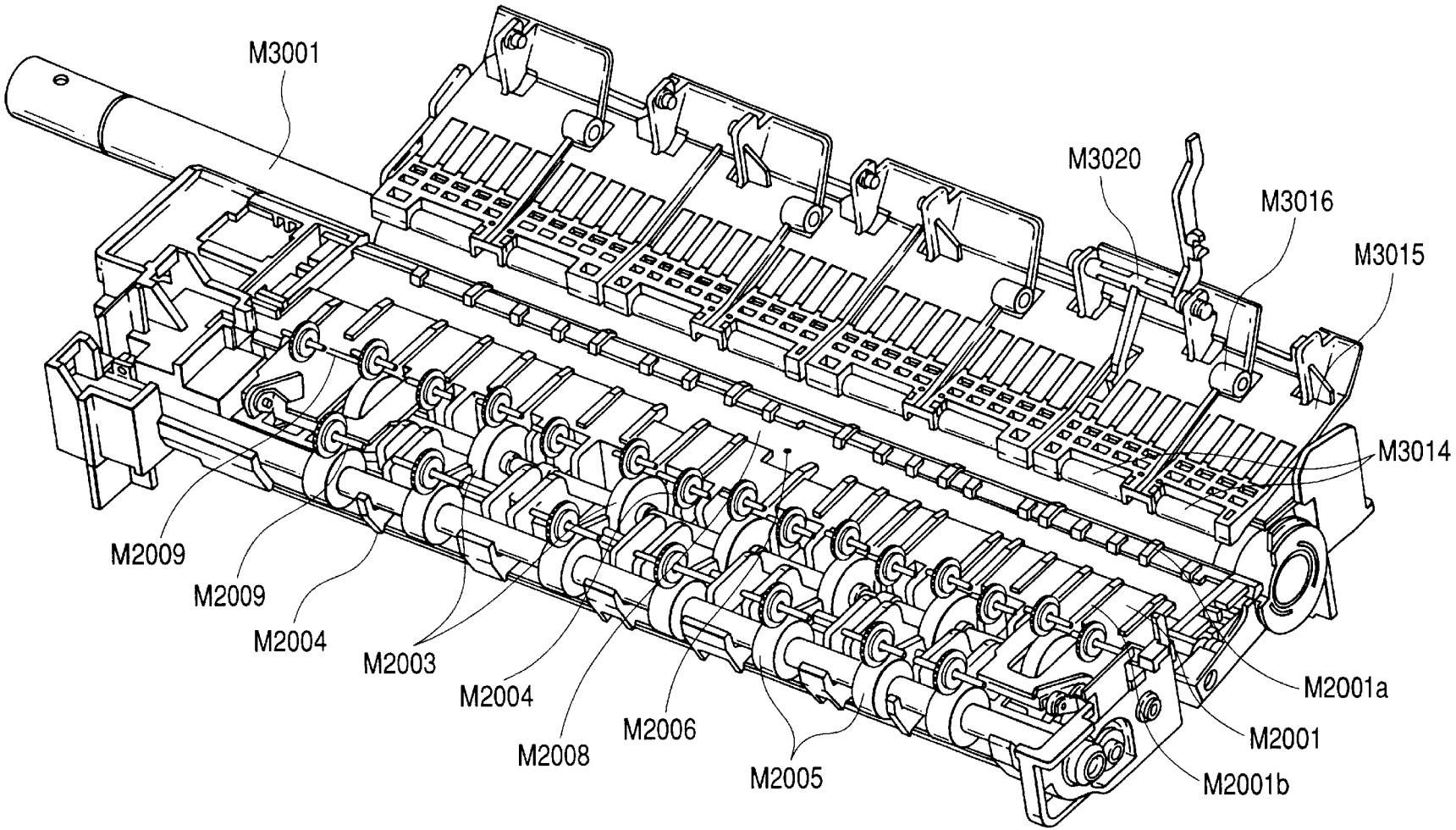
FIG. 4 is a perspective view for showing a state where an internal construction of the ink jet printer shown in FIG. 3 is partially removed.

FIG. 4 is a perspective view for showing a state where some of internal construction components, for example, the recording head cartridge H1000, etc. of the ink jet printer shown in FIG. 3 is removed.

As shown in FIG. 4, the sheet discharging section M3030 has the discharging roller M2003, the discharging roller M2005 disposed on the downstream side of this discharging roller M2003, a spur M2004 which is pressed by the discharging rollers M2003 and M2005 to rotate correspondingly in order to convey the recording paper P as sandwiching it between these discharging rollers M2003 and M2005, and the discharging tray M1004 for loading thereon the recording sheet P discharged.

As shown in FIG. 3, the driving force of the sheet discharging section M3030 is transmitted by transmitting the driving force of the LF motor E0002 via an LF intermediate two-stage gear M3012 to a gear M3013 of the sheet discharging roller M2005 and then from the gear M3013 and an output gear (not shown) of the sheet discharging roller M2005 positioned at the other end via a sheet discharging idler gear (not shown) to an input gear (not shown) positioned at an end of the sheet discharging roller M2003.

The recording sheet P conveyed to the sheet discharging section M3030 receives the conveyance force from the discharging rollers M2003 and M2005 and the spur M2004. But, the recording sheet can be conveyed properly and smoothly due to slight contacting between the recording sheet support faces M2001*a* and M2001*b* of the platen M2001 with no gap being produced therebetween, because the rotation center of the spur M2004 disposed with respect to the discharging roller M2004 is offset by about 2 mm to the upstream side in the conveying direction with respect to the rotation center of the discharging roller M2003.

In the present embodiment, to prevent the recording sheet P from flexing (or warping), the conveyance speed by means of the discharging roller M2003 and the spur M2004 is set in configuration to be a little higher than that by means of the LF roller M3001 and the pinch roller M3014.

When the ink image is recorded on the recording sheet P completely and the bottom of the recording sheet P passes through between the LF roller M3001 and the pinch roller M3014, the recording sheet P is conveyed only by the discharging rollers M2003 and M2005 and the spur M2004, to complete the discharging of the recording sheet P.

Note here that the platen M2001 is provided with a preliminary ejection outlet M2008 for guiding ink which is deflected out from the recording sheet P and arrives at the platen side in the top-and-bottom edge or right-and-left-edge blank-less recording operation. The preliminary ejection outlet M2008 is provided in such a manner as to extend in the scanning direction of the recording head and is provided therein with a platen absorber M2006 for absorbing and holding the ink guided through the preliminary ejection outlet M2008. The ink ejected as deflected out from the edges of the various sizes of fixed-type forms (for example, LTR size, A4 size, L size, 2L size, 4"×6" size of forms) is guided through the preliminary ejection outlet M2008 to be absorbed and held by the platen absorber M2006.

(Recording Section)

Figure 5:
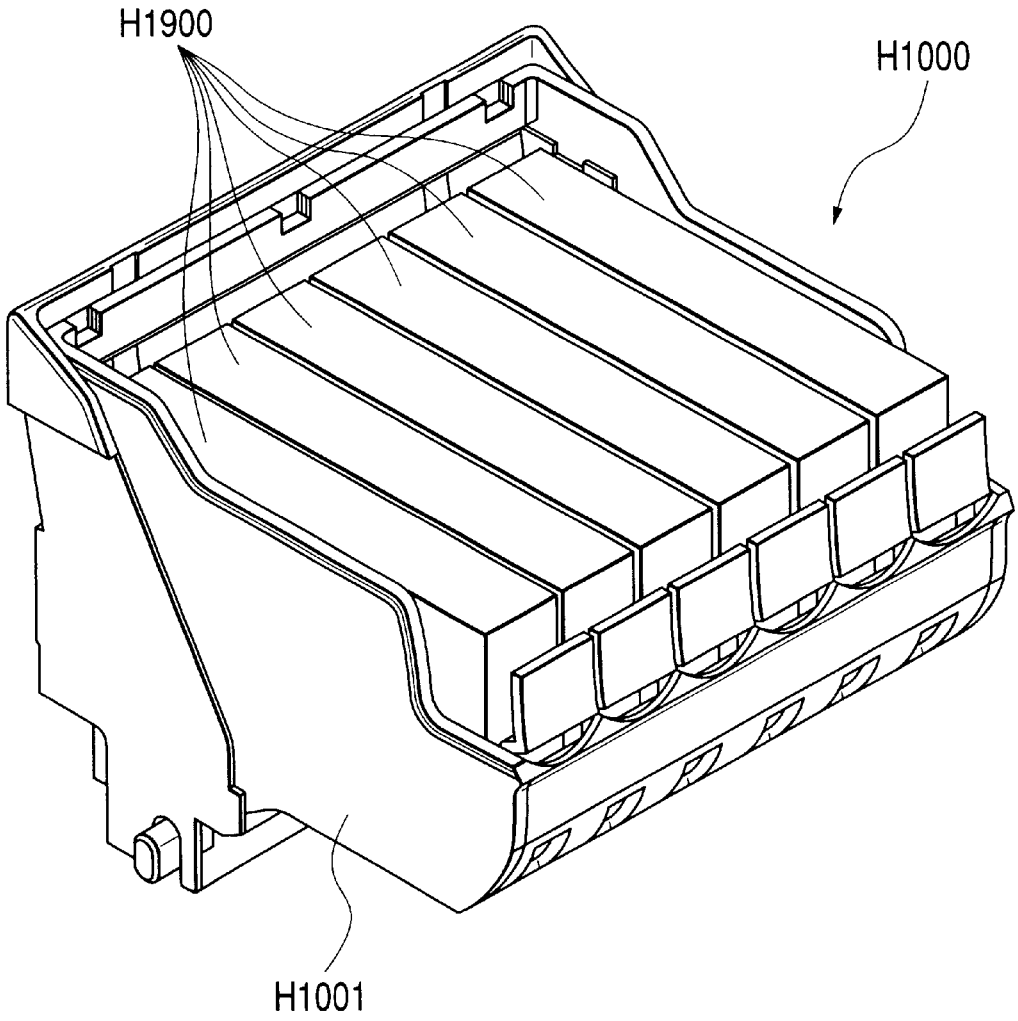
FIG. 5 is a perspective view for showing a recording head cartridge used in the ink jet printer shown in FIG. 3.
Figure 6:
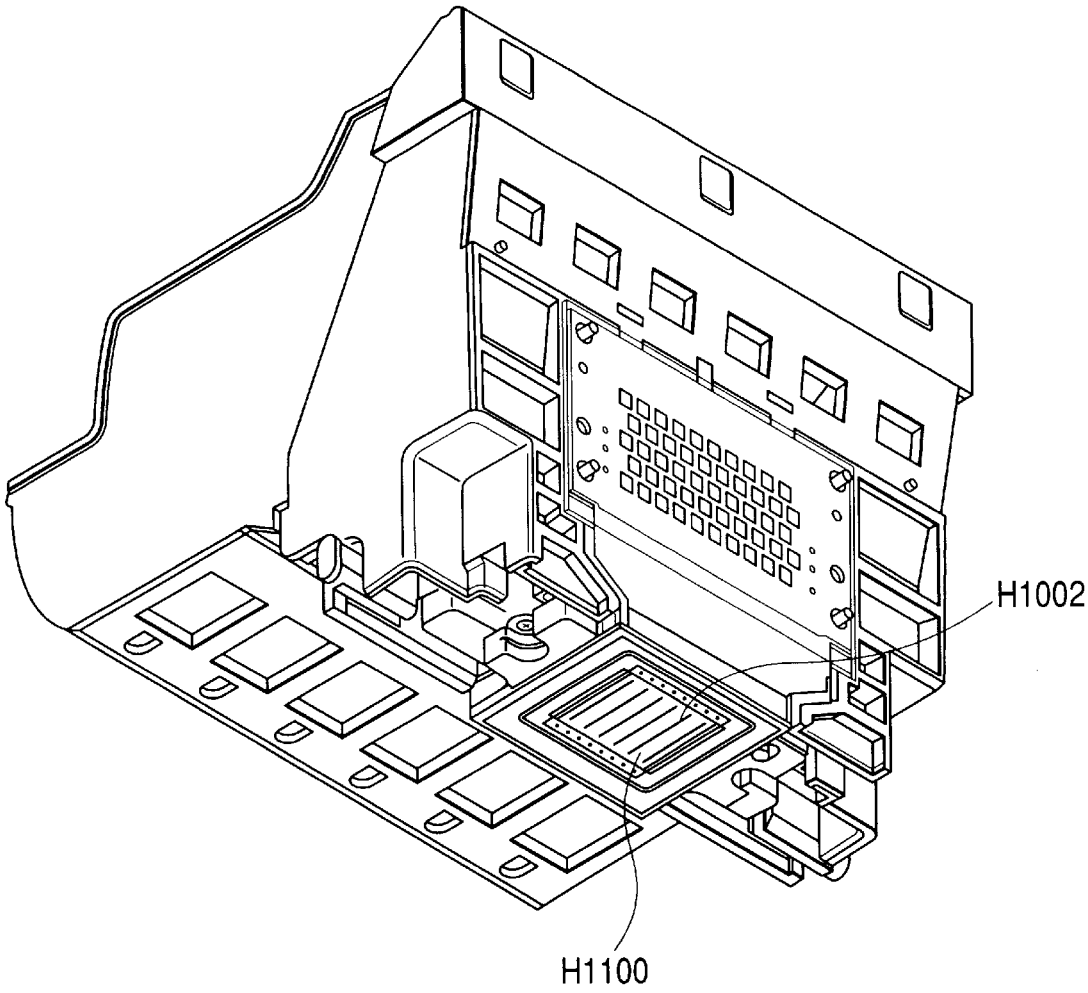
FIG. 6 is a perspective view for showing nozzles of a recording head mounted on the recording head cartridge shown in FIG. 5.

FIG. 5 is a perspective of the recording head cartridge provided to the recording section of the printer shown in FIG. 1 and FIG. 6 is a perspective view for showing nozzles of the recording head cartridge shown in FIG. 5.

The recording section M4000 has the carriage M4001 movably supported by the carriage shaft M4021 and the recording head cartridge H1000 detachably mounted to this carriage M4001.

The recording head cartridge H1000 has an ink tank H1900 for storing ink and a recording head 1001 for ejecting ink supplied from the ink tank H1900 from its nozzles corresponding to the recording information. The recording head H1001 is of a so-called cartridge type, by which it is mounted to the carriage M4001 detachably.

To enable photo-like high image quality color recording, the recording head H1001 referred to here is provided with ink tanks for such various colors as black, light magenta, light cyan, magenta, cyan, and yellow, as well as such various components as a recording element board H1100 having nozzles or nozzle arrays H1002 to eject the ink supplied from these ink tanks.

Specifically, as shown in FIG. 6, the recording element board H1100 is provided with a silicon substrate on whose one side are formed by a known film forming technology a plurality of recording elements for ejecting ink and electric wirings such as an A1 wiring for supplying power to these recording elements, a plurality of ink flow paths corresponding to these recording elements and a plurality of ejection outlets formed by a photolithographic technology, and a common liquid chamber formed as opened to the back side for supplying ink to the plurality of ink flow paths.

The following will describe an electric circuit configuration of the ink jet printer according to the present embodiment.

Figure 7:
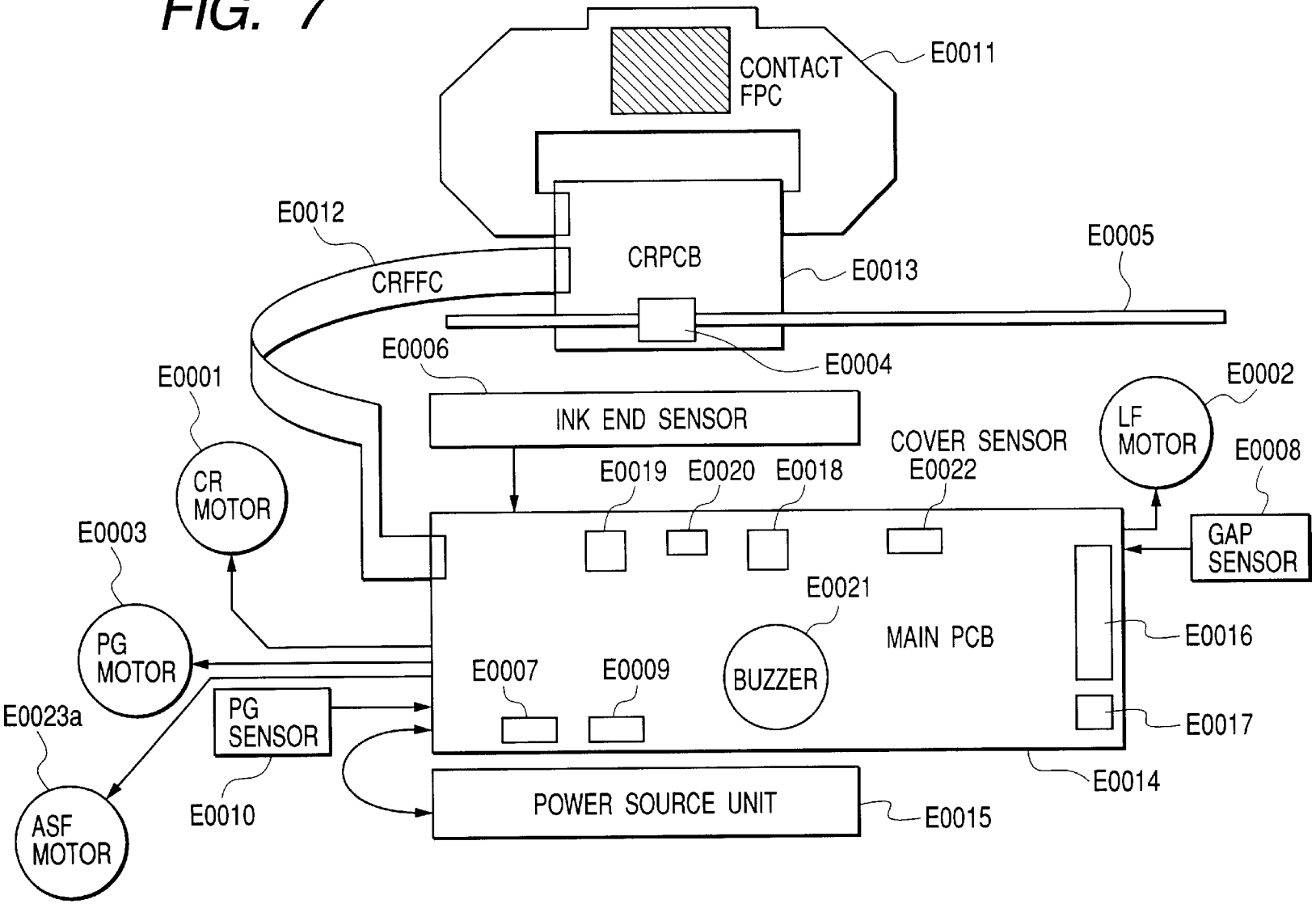
FIG. 7 is a block diagram for outlining an overall configuration of an electric circuit of the ink jet printer shown in FIG. 3.

FIG. 7 is a diagram for outlining an overall configuration of the electric circuit of the ink jet printer according to the present embodiment. This electric circuit is mainly comprised of a carriage board (CRPCB) E0013, a main PCB (Printed Circuit Board) E0014, a power source unit E0015, etc.

The power source unit E0015 is connected with the main PCB E0014 to supply power for various driving operations.

The carriage board E0013 is a PCB unit mounted to the carriage M4001, to function as an interface for transmission and reception of a signal with the recording head via a contact FPC E0011 and also to detect a change in positional relationship between an encoder scale E0005 and an encoder sensor E0004 based on a pulse signal output from an encoder sensor E0004 according to the movement of the carriage M4001 to then provide a resultant output signal to the main PCB E0014 via a flexible flat cable (CRFFC) E0012.

The main PCB E0014 is a PCB unit for controlling the driving of the sections of the ink jet printer according to the present embodiment and has thereon I/O ports corresponding to a paper edge detection sensor (PE sensor) E0007, an ASF sensor E0009, a cover sensor E0022, a parallel interface (parallel I/F) E0016, a serial interface (serial I/F) E0017, the resumption key E0019, the LED E0020, the power source key E0018, a buzzer E0021, etc. and are connected to a CR motor E0001, the LF motor E0002, a PG motor E0003, and an ASF motor E0003*a* to control their driving and also has a connection interface with an ink end sensor E0006, a GAP sensor E0008, a PG sensor E0010, a CRFFC E0012, and the power source unit E0015.

Figure 8:
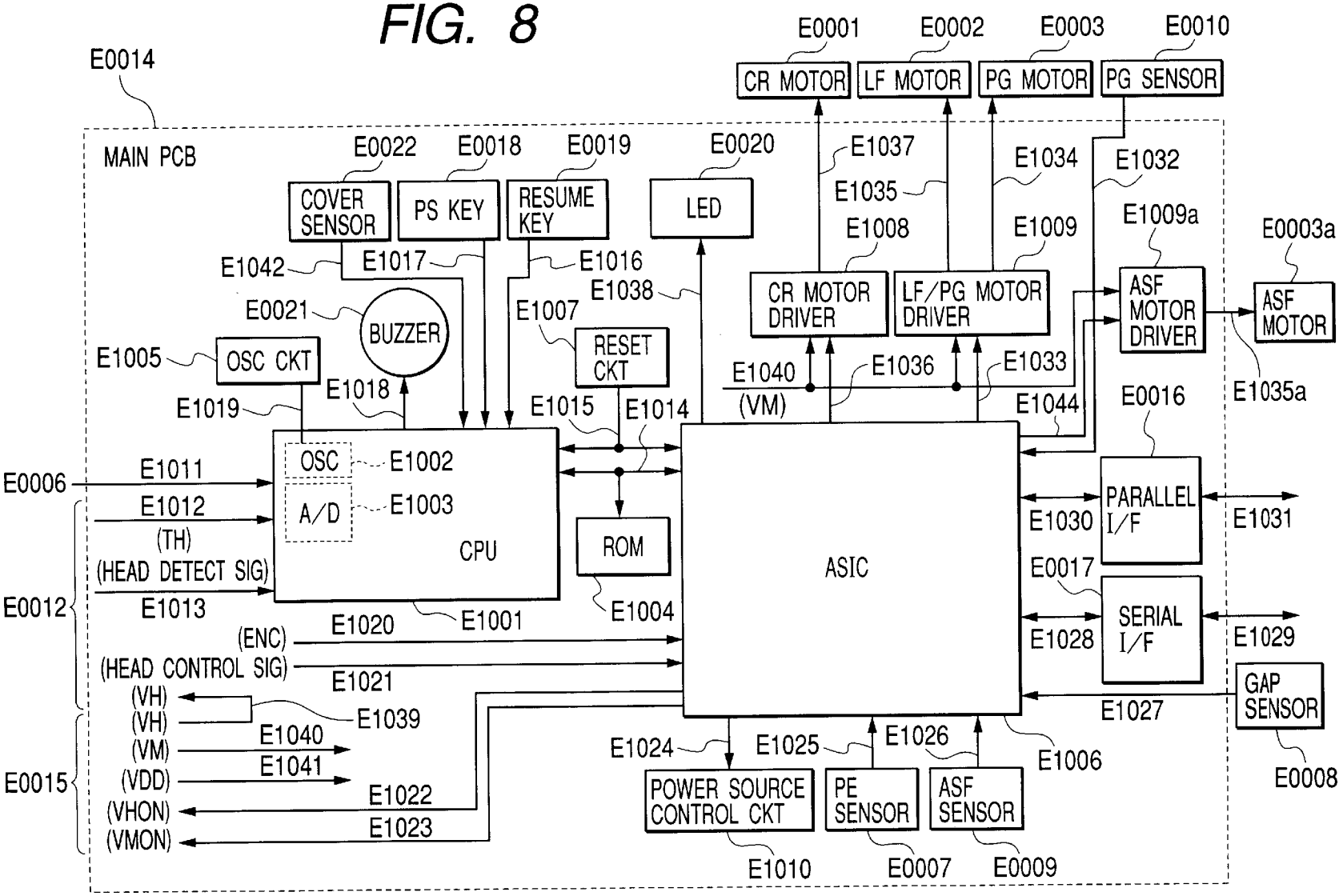
FIG. 8 is a block diagram for showing an internal configuration of a main PCB shown in FIG. 7.

FIG. 8 is a block diagram for showing an internal configuration of the main PCB. In FIG. 8, E1001 indicates a CPU. This CPU E1001 has an oscillator OSC E1002 therein and is connected to an oscillation circuit E1005 to generate a system clock signal based on its output signal E1019. Furthermore, the CPU E1001 is connected to a ROM E1004 and an ASIC (Application Specific Integrated Circuit) E1006 via a control bus E1014 to control, according to a program stored in the ROM E1004, the ASIC E1006, detect a state of an input signal (POWER (PS key input)) E1017 sent from the PS key, an input signal (RESUMPTION (key input)) E1016 sent from the resumption key E1009, a cover detection signal E1042, and a head detection signal (HSENS) E1013, drive a buzzer E0021 based on a buzzer signal (BUZ) E1018, detect a state of an ink end detection signal (INKS) E1011 connected to an incorporated A/D converter E1003 and a thermistor temperature detection signal (TH) E1012, perform various logical operations, and decide conditions, thus controlling the driving of the ink jet printer of the present embodiment.

In this case, the head detection signal E1013 is used to detect whether the head is mounted and is input from the recording head H1001 via a flexible flat cable E0012, the carriage board E0013, and the contact flexible print cable E0011, the ink end detection signal E1011 is an analog signal output from the ink end sensor E0006, and the thermistor temperature detection signal E1012 is an analog signal sent from a thermistor (not shown) provided on the carriage board E0013.

E1008 indicates a CR motor driver, which is supplied with driving power from a motor power source (VM) E1040 to generate a CR motor driving signal E1037 according to a CR motor control signal E1036 sent from the ASIC E1006, thus driving the CR Motor E0001.

E1009 indicates an LF/PG motor driver, which is supplied with power from the motor power source E1040 to generate an LF motor driving signal E1035 according to a pulse motor control signal (PM control signal) E1033 sent from the ASIC E1006 in order to drive the LF motor E0002 and also to generate a PG motor driving signal E1034 in order to drive the PG motor E0003.

E1009*a* indicates an ASF motor driver, which is supplied with power from the motor power source E1040 to generate an ASF motor driving signal E1035*a* according to a pulse motor (PM) control signal E1033*a* sent from the ASIC E1006, thus driving the E0003*a*.

E1010 indicates a power source control circuit, which controls supplying of power to each of the sensors having a light emitting diode, according to a power source control signal E1024 sent from the ASIC E1006. The parallel I/F E0016 transmits a parallel I/F signal E1030 from the ASIC E1006 to a parallel I/F cable E1031 connected to an external device and also transmits a signal of the parallel I/F cable E1031 to the ASIC E1006. The serial I/F E0017 transmits a serial I/F signal E1028 from the ASIC E1006 to a serial I/F cable E1029 connected to an external device and also transmits a signal from the cable E1029 to the ASIC E1006.

The power source unit E0015 provides a head power source (VH) E1039 and a motor power source (VM) E1040 to the present main PCB E0014 and a logic power source (VDD) E1041. Furthermore, the power source unit E0015 receives a head power source ON signal (VHON) E1022 and a motor power source ON signal (VMOM) E1023 from the ASIC E1006, which are used to control the turn-ON/OFF operations of the head power source E1039 and the motor power source E1040. The logic power source (VDD) E1041 supplied from the power source unit E0015 is, as necessary, converted in voltage level and then fed to each of the devices inside and outside the main PCB E0014.

The head power source E1039 is smoothed in voltage level at the main PCB E0014 and then sent to the flexible flat cable E0011 to be used to drive the recording head H1001.

E1007 indicates a reset circuit, which detects a drop in voltage of the logic power source E1040 to supply a reset signal (RESET) E1015 to the CPU E1001 and the ASIC E1006 for their initialization.

The ASIC E1006 is a one-chip semiconductor IC, which is controlled via the control bus E1014 by the CPU E1001 to output the above-mentioned CR motor control signal E1036, PM control signal E1033, power source control signal E1024, head power source ON signal E1022, motor power source ON signal E1023, etc., transmit and receive a signal through the parallel I/F E0016 and the serial I/F E0017, and also detect a state of a PE detection signal (PES) E1025 sent from the PE sensor E0007, an ASF detection signal (E1026 sent from the ASF sensor E0009, a GAP detection signal (GAPS) E1027 sent from the GAP sensor E0008, and a PG detection signal (PGS) E1032 sent from the PG sensor E0007 to then transmit data indicating the state to the CPU E1001 via the control bus E1014. Based on thus input data, the CPU E1001 controls the driving of the LED driving signal E1038 to cause the LED E0020 to blink.

Furthermore, the ASIC E1006 detects a state of the encoder signal (ENC) E1020 to generate a timing signal and uses a head control signal E1021 to interface with the recording head H1001, thus controlling the recording operation. In this case, the encoder signal (ENC) E1020 is an output signal of the CR encoder sensor E0004 which is input through the flexible flat cable E0012. Furthermore, the head control signal E1021 is supplied to the recording head H1001 via the flexible flat cable E0012, the carriage board E0013, and the contact FPC E0011.

Figure 9:
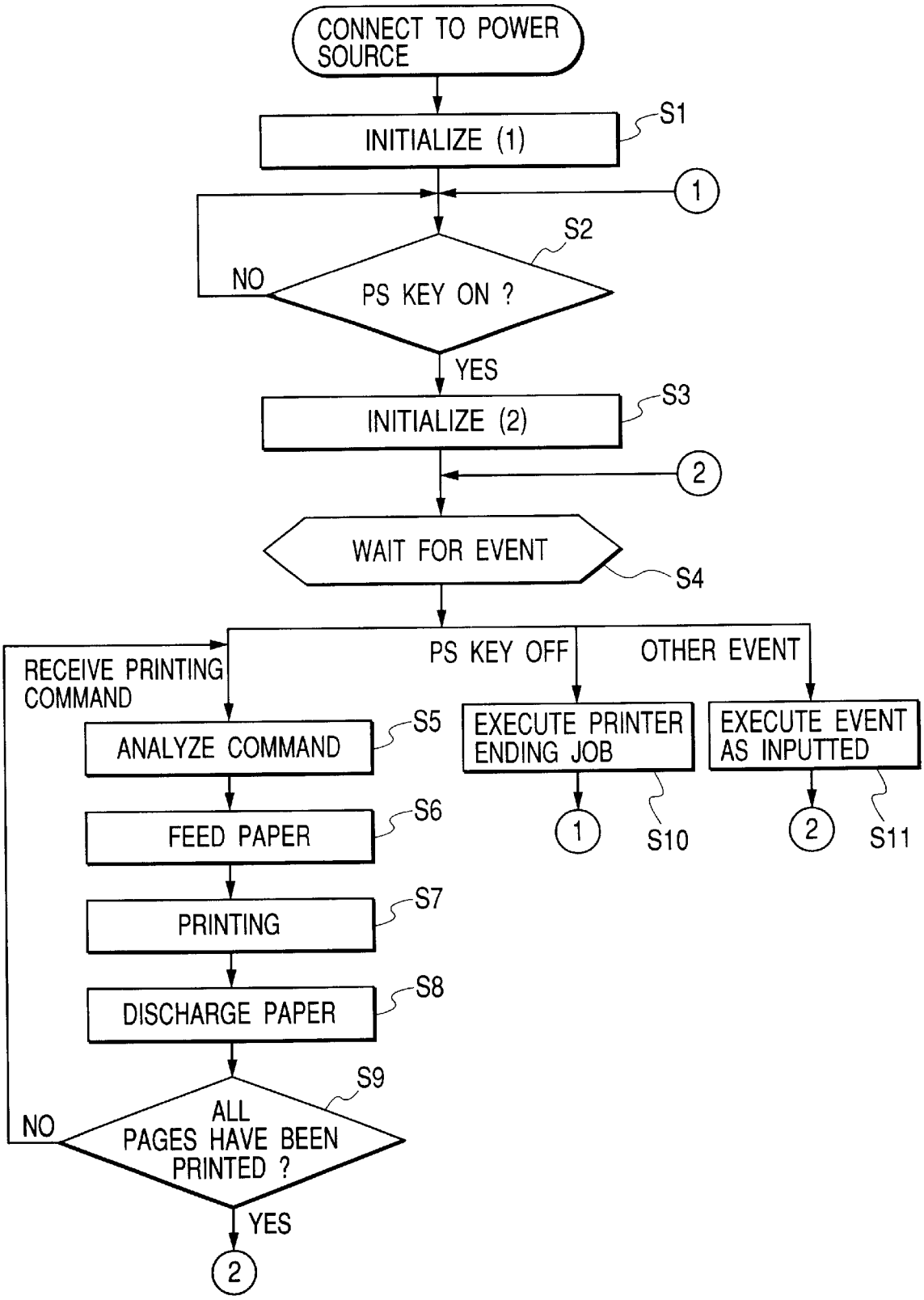
FIG. 9 is a flowchart explaining the operations of the above-mentioned inkjet printer shown in FIG. 3.

The following will specifically describe the operations of the ink jet printer having the above-mentioned configuration. FIG. 9 is a flowchart explaining the operations of the above-mentioned inkjet printer.

When the present ink jet printer is connected to the AC power source, first at step S1, the printer undergoes first initialization. In this initialization, the process checks the electric circuitry including the ROMs and RAMs of the present printer to confirm whether the present printer can normally operate electrically.

Next, at step S2, the process determines whether the power source key E0018 provided on the upper case M1002 of the apparatus body M1000 is turned ON and, if this key is pressed, goes to the next step of S3 to perform second initialization.

In this second initialization, the process checks the various driving mechanisms and the head system of the present printer. That is, the process confirms whether the present printer can normally operate when the various motors are initialized and head information is read in.

Next, at the next step of S4, the process waits for an event. That is, the process monitors, on the present printer, an instruction event sent from an external I/F, a user-operated panel key event, and an internal control event and, upon occurrence of any of such events, executes processing that corresponds to the event.

For example, if having received a printing instruction event at step S4, the process goes to step S5, while if a user-operated power source key event or any other event has occurred at step S4, the process goes to step S10 or step S11, respectively. In this case, at step S5, the process analyzes the printing instruction sent from the external I/F to decide specified sheet type, form size, printing quality, and sheet feeding method and store data indicating a decision result in a RAM E2005 in the present printer and then goes to step S6.

Next, at step S6, the process starts sheet feeding according to the sheet feeding method specified at step S5 to feed the sheet to the recording start position and then goes to step S7. At step S7, the process performs recording. Then, the process drives the CR motor E0001 to start moving the carriage M4001 in a scanning direction and also provides the recording head H1001 with recording data stored in a print buffer E2104 to record one line of the recording data. Upon completion of recording of the one-line of the recording data, the process drives the LF motor E0002 to rotate the LF roller M3001, thus feeding the sheet in a sub-scanning direction. Then, the process repeats these steps until one page of the recording data sent from the external I/F is recorded completely and then goes to step S8.

At step S8, the process drives the ASF motor 0003*a* to rotate the sheet discharging rollers M2003 and M2005 in order to repeat the sheet feeding operation until it decides that the form has completely been fed out from the present printer and, whereupon the form is completely discharged into the sheet discharging tray M1004*a*.

Next, at step S9, the process decides whether all the pages to be recorded are done so completely and, if there is some left yet to be recorded, returns to step S5 to repeat the above-mentioned processing of steps 5 to 9 until all of these pages are recorded completely and then goes to step S4 to wait for the next event.

At step S10, on the other hand, the process executes printer ending processing to stop the present printer in operation. That is, the process shifts into a state that enables power-OFF to turn OFF the power source and then goes to step S4 to wait for the next event.

Furthermore, at step S11, the process executes event processing other than the above. For example, the process executes such processing as to correspond to a recovery instruction event sent from any of the various panel keys of the present printer or the external I/F or a recovery event occurring in the present printer. After completion of the processing, the process goes to step S4 to wait for the next event.

[Characteristic Configuration]

The following will describe a characteristic configuration of the ink jet printer according to the present invention.

The ink jet printer of the present invention features such a configuration that using a configuration of the platen side for regulating the position of a recording sheet at the recording position as unchanged, such a recording head can be used as to be different in position of a nozzle used in top-and-bottom blank-less recording. In the following, the embodiments of the characteristic configuration of the present invention is described with reference to an example of an ink jet printer having the above-mentioned "basic configuration" with reference to the drawings.

(First Embodiment)

The present embodiment is described with respect to a configuration and a recording operation of each of the recording heads with different nozzle lengths when they are used.

Figure 10:
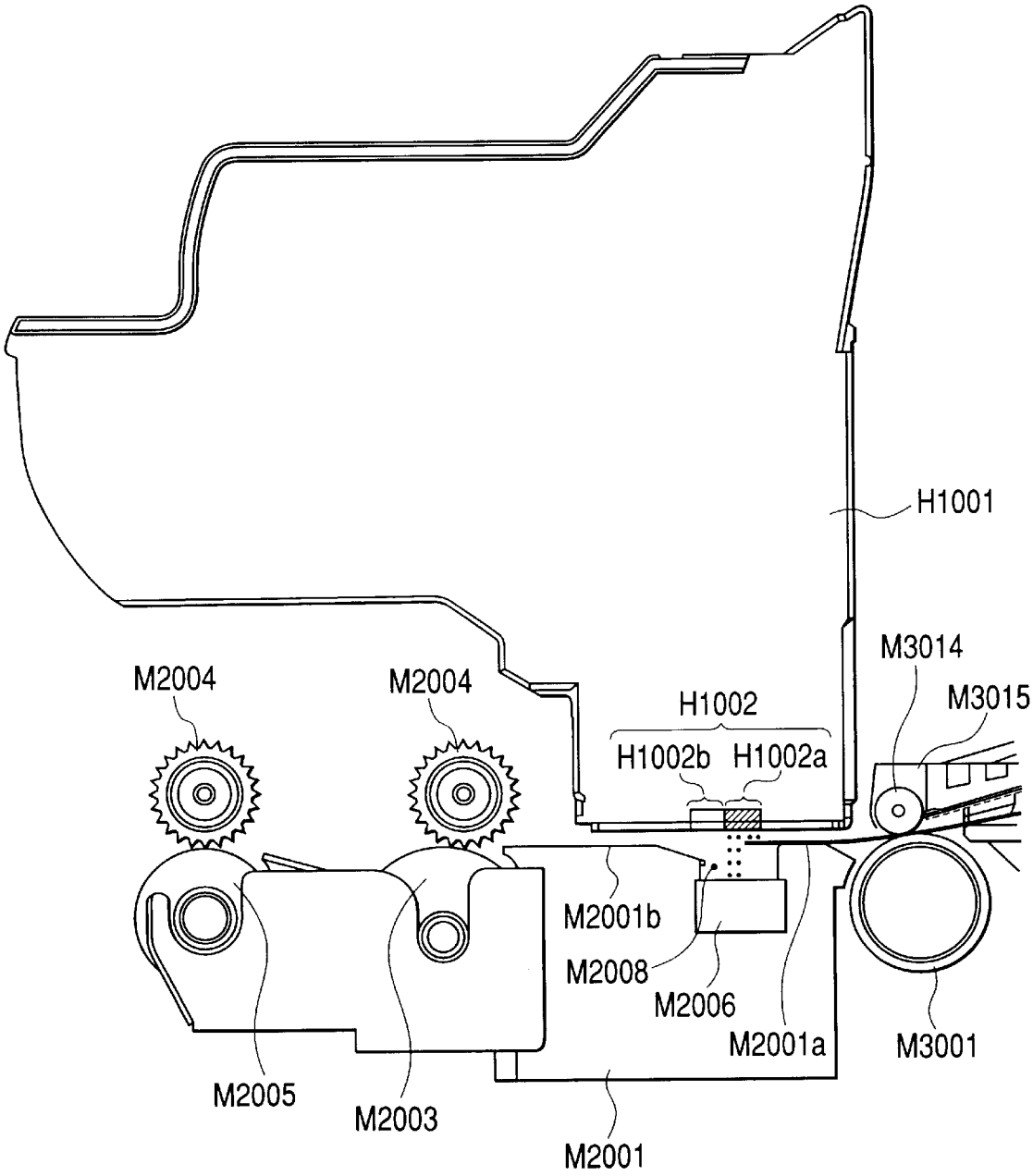
FIG. 10 is a schematic diagram for explaining recording at a top of a recording sheet in the ink jet printer shown in FIG. 3.
Figure 11:
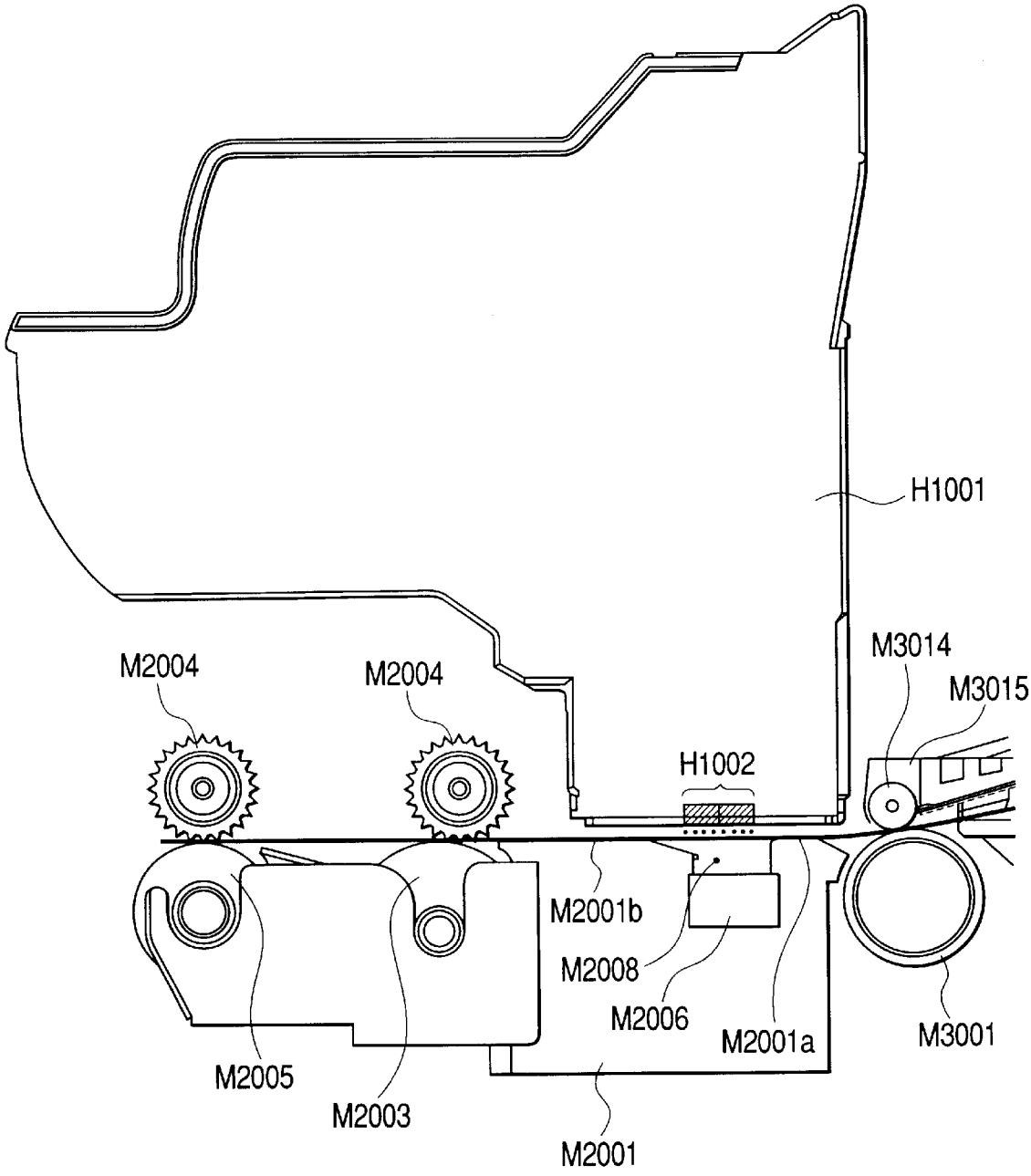
FIG. 11 is a schematic diagram for explaining recording at a middle of the recording sheet in the ink jet printer shown in FIG. 3.
Figure 12:
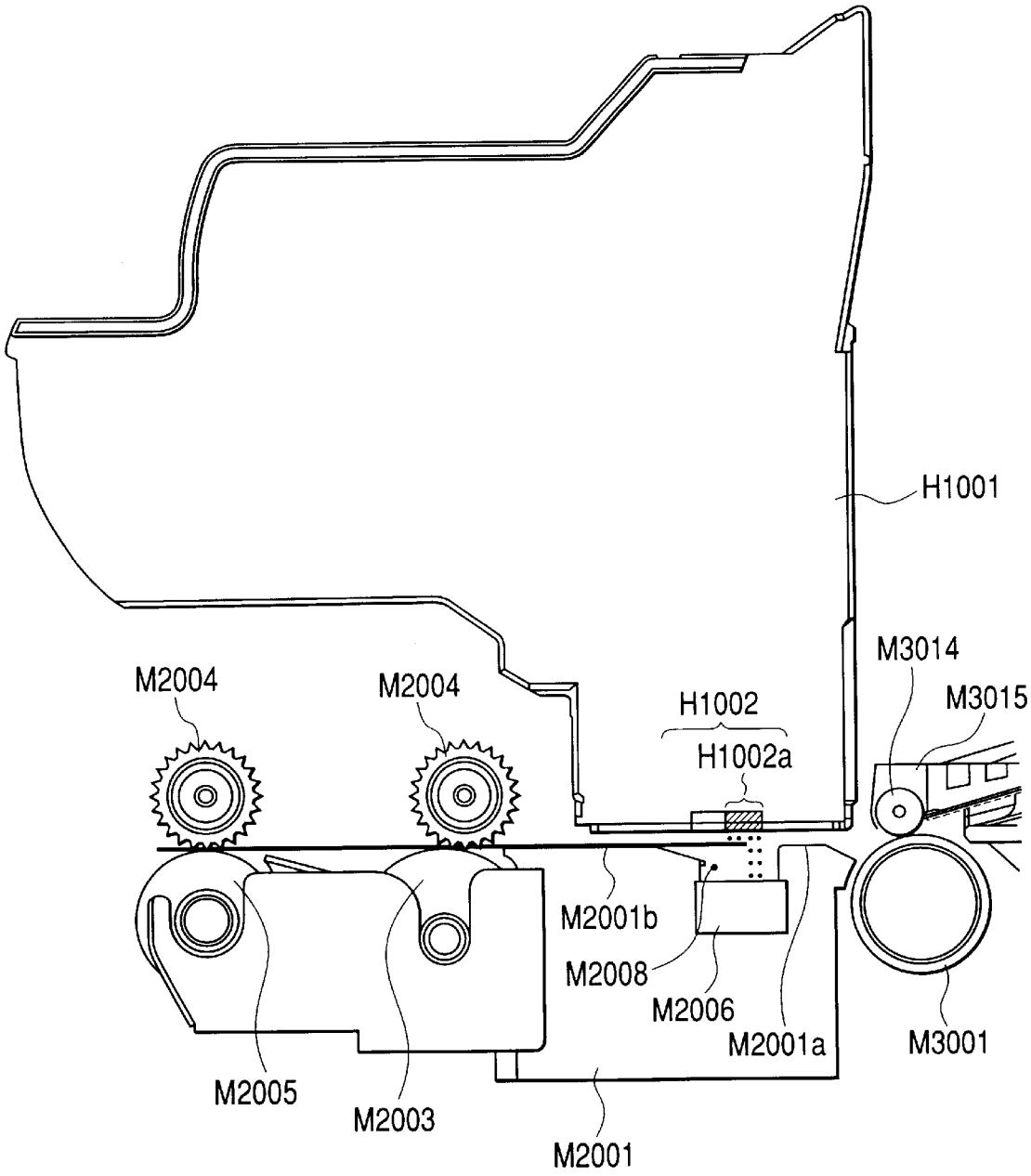
FIG. 12 is a schematic diagram for explaining recording at a bottom of the recording sheet in the ink jet printer shown in FIG. 3.

FIGS. 10 to 12 are illustrations for explaining top-and-bottom blank-less recording performed in the ink jet printer shown in FIG. 1, of which, FIG. 10 is a schematic diagram for explaining recording at the top of a recording sheet, FIG. 11 is a schematic diagram for explaining recording at the middle of the recording sheet, and FIG. 12 is a schematic diagram for explaining recording at the bottom of the recording sheet.

As shown in FIGS. 10 to 12, the recording head H1001 has such a construction that a nozzle row or array H1002 having a plurality of nozzles is arranged in the recording sheet conveying direction and a plurality of the nozzle rows are arranged in a direction which intersects (for example, at a right angle) with the recording sheet conveying direction, each of the nozzle arrays H1002 being divided into one half nozzle array H1002*a* on the upstream side in the conveying direction and another half nozzle array H1002*b* on the downstream side in the conveying direction. The preliminary ejection outlet M2008 of the platen M2001 arranged opposite to the recording head H1001 is arranged at such a position as to guide ink ejected out of the half-nozzle array H1002*a* of the nozzle array H1002.

The recording sheet P fed by the automatic conveying section M3022 and conveyed by the conveying section M3029 while having its position regulated by the recording sheet support face M2001*a* of the platen M2001 undergoes recording at its top using the half-nozzle array H1002*a* on the upstream side in the conveying direction, that is, top blank-less recording as shown in FIG. 10. In this case, a conveying amount (feed amount) of the recording sheet P corresponds to the nozzle length of the nozzle array H1002*a*.

In this top blank-less recording operation, such part of the ink ejected out of the nozzle array H1002*a* as to have been deflected from the recording sheet P (that is, from the top of the recording sheet P) is guided through the preliminary ejection outlet M2008 to be absorbed and held by the platen absorber M2016 provided in the preliminary ejection outlet M2008.

When the recording on the recording sheet P by means of the recording head H1001 advances up to its top completely, subsequently, as shown in FIG. 11, the process takes another step to use all the nozzles (both of the nozzle arrays H1002*a* and H1002*b*) of the nozzle array H1002 of the recording head H1001 and also increases the conveying amount (feed amount) of the recording sheet P to such a value as to match the overall nozzle length of the nozzle array H1002, thus recording data at the middle of the recording sheet P. In this case, the position of the recording sheet P is regulated by the recording sheet support faces M2001*a* and M2001*b*.

In this case of recording at the middle, the number of the nozzles used in recording is twice the number in the case of top blank-less recording, accompanied by an increase in the conveying amount (feed amount) of the recording sheet P as well. Accordingly, recording at the middle of the recording sheet P can be performed faster than top blank-less recording.

When the recording onto the recording sheet P by means of the recording head H1001 further advances up to its middle completely, subsequently the recording head H1001 shifts to bottom blank-less recording of the recording sheet P as shown in FIG. 12. In the case of this bottom blank-less recording, the nozzle array H1002*a* of the nozzle array H1002 is used again, to record the data at the bottom of the recording sheet P after the recording sheet P is fed by a conveying amount (feed amount) that matches the nozzle length of the nozzle array H1002*a*.

As in the case of the above-mentioned top blank-less recording operation, in the case of this bottom blank-less recording operation also, such part of the ink ejected out of the nozzle array H1002*a* as to have been deflected out from the recording sheet P (from the bottom of the recording sheet P) is guided through the preliminary ejection outlet M2008 to be absorbed and held by the platen absorber M2016 provided in the preliminary ejection outlet M2008.

The above-mentioned series of recording operations enables top-and-bottom blank-less recording without contaminating the platen M2001 and the recording sheet P.

The following will describe a configuration and recording operations of a recording head which can replace the recording head H1001 and which has a nozzle length different from that of the nozzle H1002.

Figure 13:
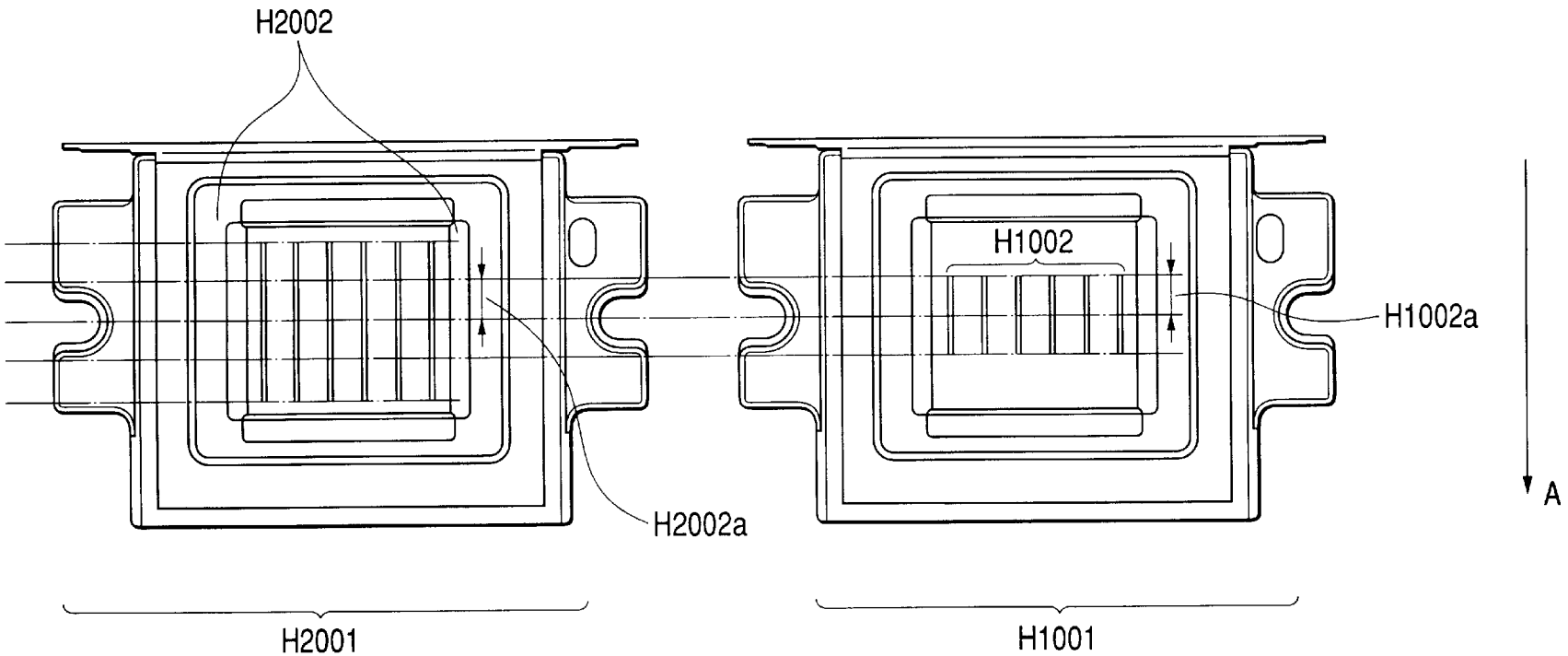
FIG. 13 is a schematic diagram for showing a positional relationship of nozzles between the recording head shown in FIGS. 10 to 12 and a recording head having twice the nozzle length.

FIG. 13 is a schematic diagram for showing a positional relationship of nozzles between the recording head shown in FIGS. 10 to 12 and a recording head having twice the nozzle length. In FIG. 13, an arrow A indicates a direction in which the recording sheet is conveyed.

In FIG. 13, the nozzle array H2002 of the recording head H2001 has twice the nozzle length of the nozzle array H1002 of the recording head H1001. The nozzle array H2002 is divided into a first half nozzle array on the upstream side in the conveying direction and a second half nozzle array on the downstream side therein, which first half nozzle array is further divided into a first half A nozzle array on the upstream side in the conveying direction and a first half B nozzle array on the downstream side therein and which second half nozzle array is also further divided into a second half A nozzle array on the upstream side in the conveying direction and a second half B nozzle array on the downstream side therein. Thus, the nozzle array H2002 is divided into four regions.

The nozzle array H2002 of the recording head H2001 has the following positional relationship with respect to the nozzle array H1002 of the above-mentioned recording head H1001.

The nozzle-length directional center of the nozzle array H2002 agrees with that of the nozzle array H1002. Furthermore, the positional relationship between the first B nozzle array H2002*a* of the nozzle array H2002 and the preliminary ejection outlet M2008 of the platen M2001 is that same as that between the nozzle array H1002*a* on the upstream side in the conveying direction of the nozzle array H1002 of the above-mentioned recording head H1001 and the preliminary ejection outlet M2008 of the platen M2001.

Figure 14:
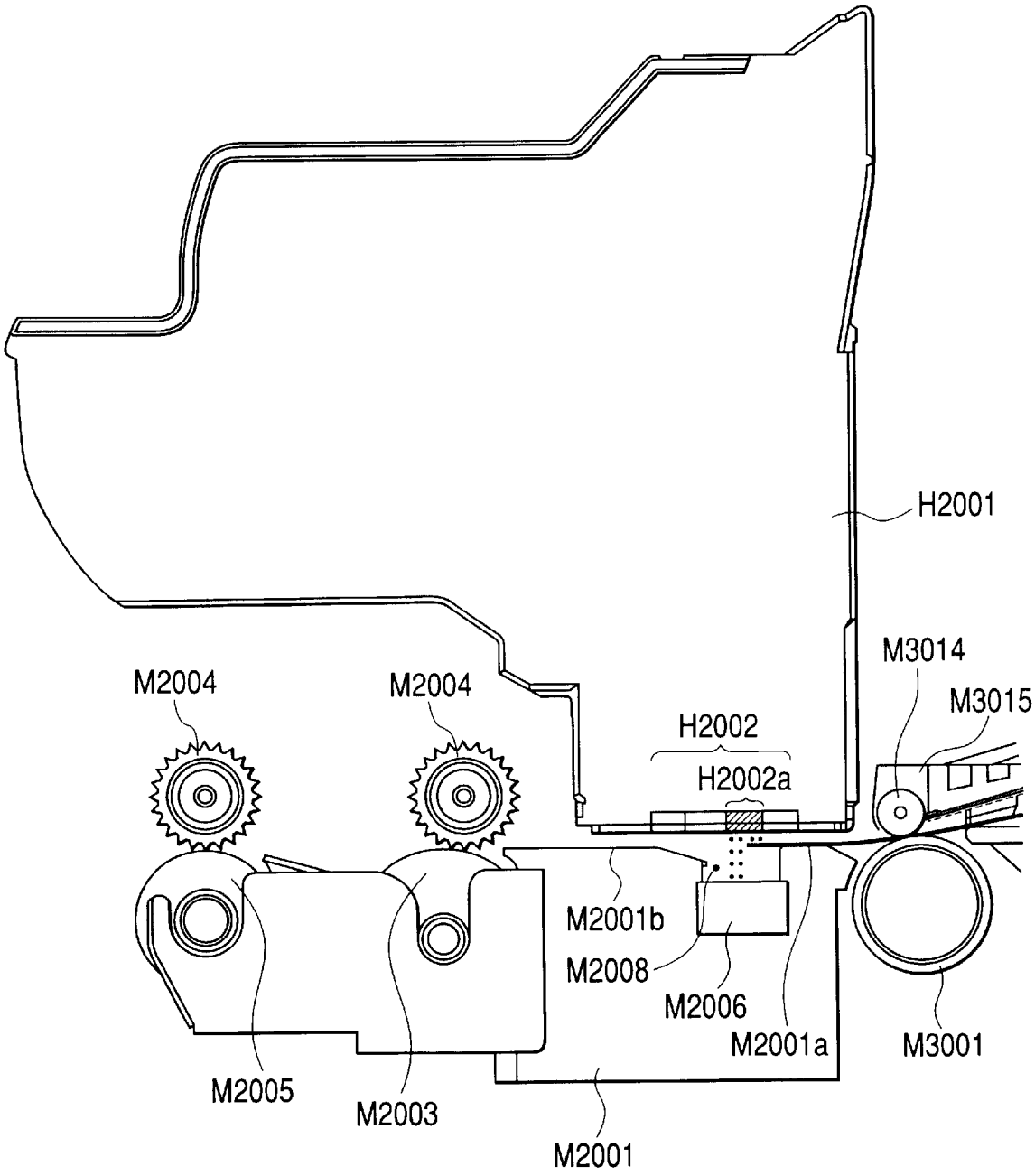
FIG. 14 is a schematic diagram for explaining recording at the top of the recording sheet when the recording head having twice the nozzle length shown in FIG. 13 is used.
Figure 15:
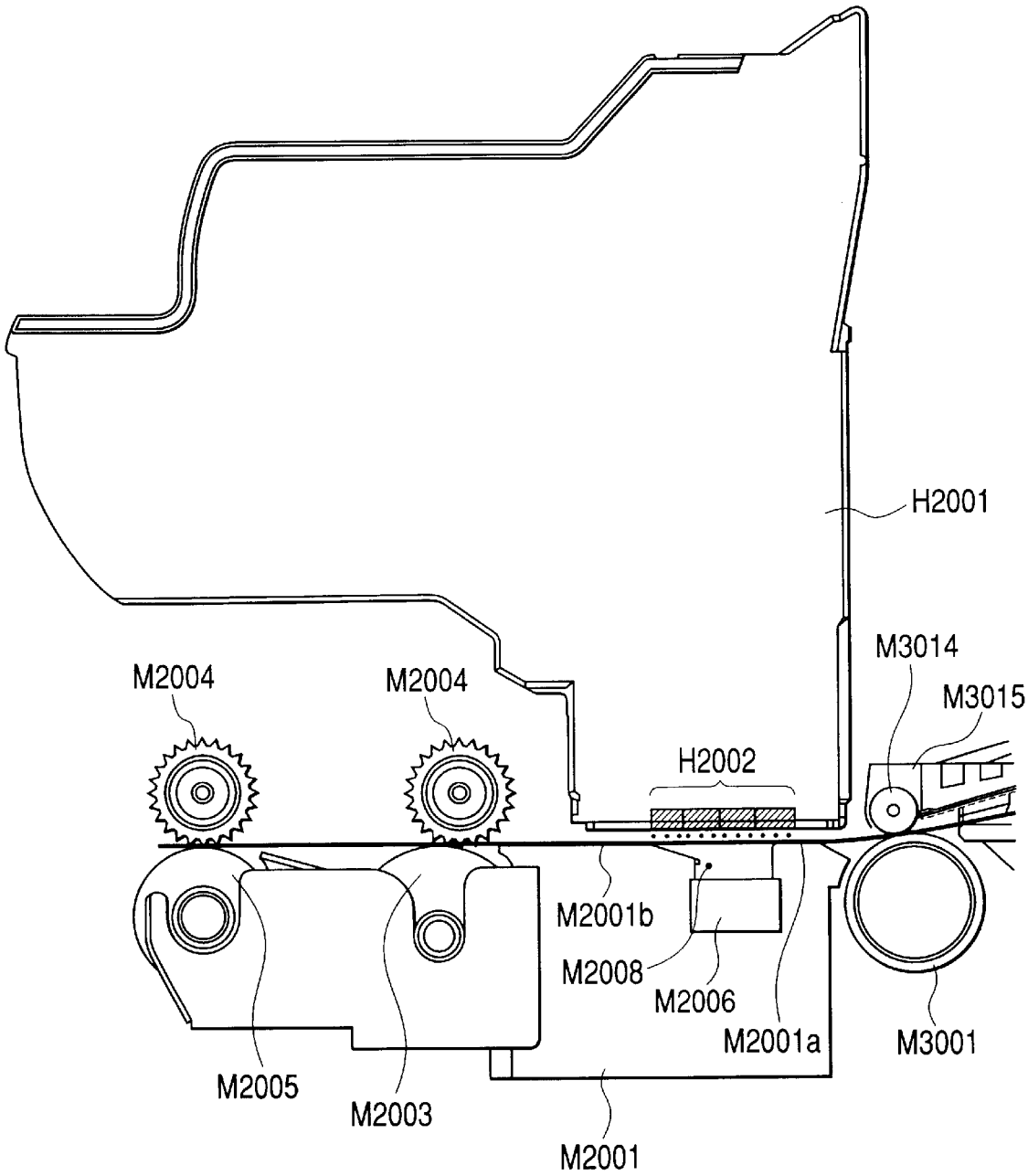
FIG. 15 is a schematic diagram for explaining recording at the middle of the recording sheet when the recording head having twice the nozzle length shown in FIG. 13 is used.
Figure 16:
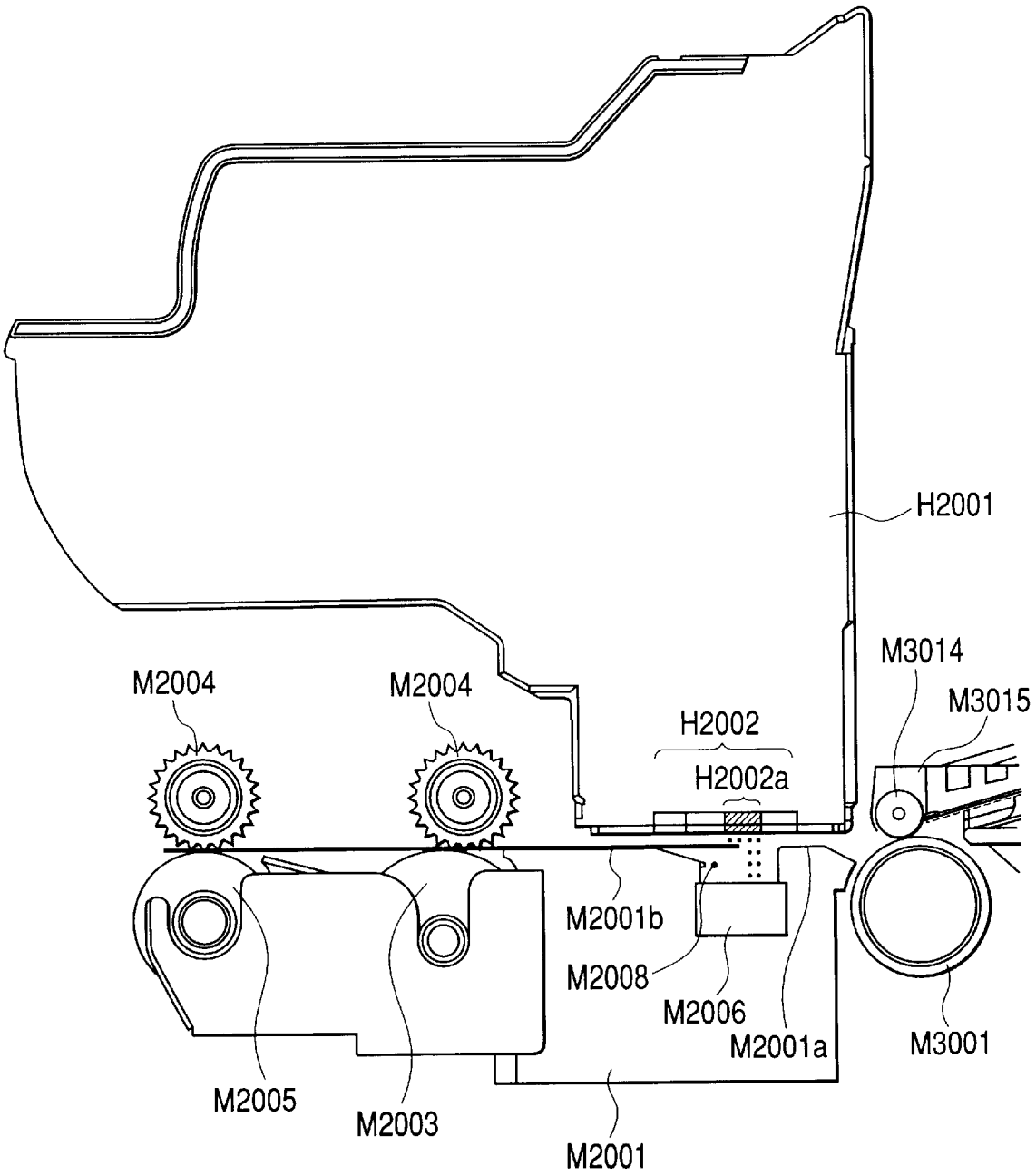
FIG. 16 is a schematic diagram for explaining recording at the bottom of the recording sheet when the recording head having twice the nozzle length shown in FIG. 13 is used.

The following will describe a case where this recording head H2001 is used to perform top-and-bottom blank-less recording. FIGS. 14 to 16 explain top-and-bottom blank-less recording when the recording head H2001 shown in FIG. 13 is used, of which, FIG. 14 is a schematic diagram for explaining recording at the top of the recording sheet, FIG. 15 is a schematic diagram for explaining recording at the middle of the recording sheet, and FIG. 16 is a schematic diagram for explaining recording at the bottom of the recording sheet.

The recording sheet P fed by the automatic conveying section M3022 and conveyed by the conveying section M3029 while having its position regulated by the recording sheet support face M2001*a* of the platen M2001 undergoes recording at its top using the upstream-side second-block nozzle array H2002*a* of the nozzle array H2002 of the recording head H2001 with the nozzle length divided into four regions, that is top blank-less recording as shown in FIG. 14. In this case, a conveying amount (feed amount) of the recording sheet P corresponds to the nozzle length of the nozzle H2002*a*.

In this top blank-less recording operation, such part of the ink ejected out of the nozzle array H2002*a* as to have been deflected from the recording sheet P (that is, from the top of the recording sheet P) is guided through the preliminary ejection outlet M2008 to be absorbed and held by the platen absorber M2016 provided in the preliminary ejection outlet M2008.

When the recording on the recording sheet P by means of the recording head H2001 advances up to its top completely, subsequently, as shown in FIG. 15, the process takes another step to use all the nozzles of the nozzle array H2002 of the recording head H2001 and also increases the conveying amount (feed amount) of the recording sheet P to such a value as to match the overall nozzle length of the nozzle array H2002, thus recording data at the middle of the recording sheet P. In this case, the position of the recording sheet P is regulated by the recording sheet support faces M2001*a* and M2001*b*.

In this case of recording at the middle, the number of the nozzles used in recording is four times that in the case of top blank-less recording, accompanied by an increase in the conveying amount (feed amount) of the recording sheet P as well. Accordingly, recording at the middle of the recording sheet P can be performed faster than top blank-less recording.

When the recording onto the recording sheet P by means of the recording head H2001 further advances up to its middle completely, subsequently the recording head H2001 shifts to bottom blank-less recording of the recording sheet P as shown in FIG. 16. In this case of bottom blank-less recording, the nozzle array H2002*a* of the nozzle array H2002 is used again, to record the data at the bottom of the recording sheet P after the recording sheet P is fed by a conveying amount (feed amount) that matches the nozzle length of the nozzle array H2002*a*.

As in the case of the above-mentioned top blank-less recording operation, in the case of this bottom blank-less recording operation also, such part of the ink ejected out of the nozzle array H2002*a* as to have been deflected out from the recording sheet P (from the bottom of the recording sheet P) is guided through the preliminary ejection outlet M2008 to be absorbed and held by the platen absorber M2016 provided in the preliminary ejection outlet M2008.

The above-mentioned series of recording operations enables top-and-bottom blank-less recording without contaminating the platen M2001 and the recording sheet P.

As described above, in the case of the recording head H2001 different in nozzle length from the recording head H1001, by using a nozzle array at the same position (in this case, the nozzle array H2002*a* at the same position as the nozzle array H1002*a*) in the recording sheet conveying direction, it is possible to perform top-and-bottom blank-less recording without changing the position of the preliminary ejection outlet M2008 on the side of the platen M2001. It is thus possible to use the same platen M2001 even with the recording heads having different nozzle lengths. It is, therefore, possible to use the platen and the ink absorber as common parts of the various recording heads, thus reducing manufacturing costs owing to an effect of the common utilization of the parts.

Note here that preferably the preliminary ejection outlet M2008 is so sized as to guide the ink ejected out of all the nozzles of the nozzle array H1002 of the recording head H1001 or the nozzle array H2002 of the recording head H2001 at a position near both edges of the various sizes of fixed-type forms (for example, LTR size, A4 size, L size, 2L size, 4"×6" size of forms). By providing such a configuration, as in the above-mentioned case of top-and-bottom blank-less recording on a recording sheet, in the case of right-and-left-edge blank-less recording on the recording sheet, the ink deflected out from the recording sheet P (deflected from the bottom of the recording sheet P) can be guided through the preliminary ejection outlet M2008 to be absorbed and held by the platen absorber M2016. As a result, four-edge blank-less recording can be performed with the recording heads with different nozzle lengths without changing the configuration of the platen M2001.

(Second Embodiment)

The present embodiment is described with respect to a configuration and a recording operation of each of the recording heads with different nozzle lengths when they are used in top-and-bottom blank-less recording. The configuration and the operation of the recording head H1001 are already described and so their explanation is omitted.

Figure 17:
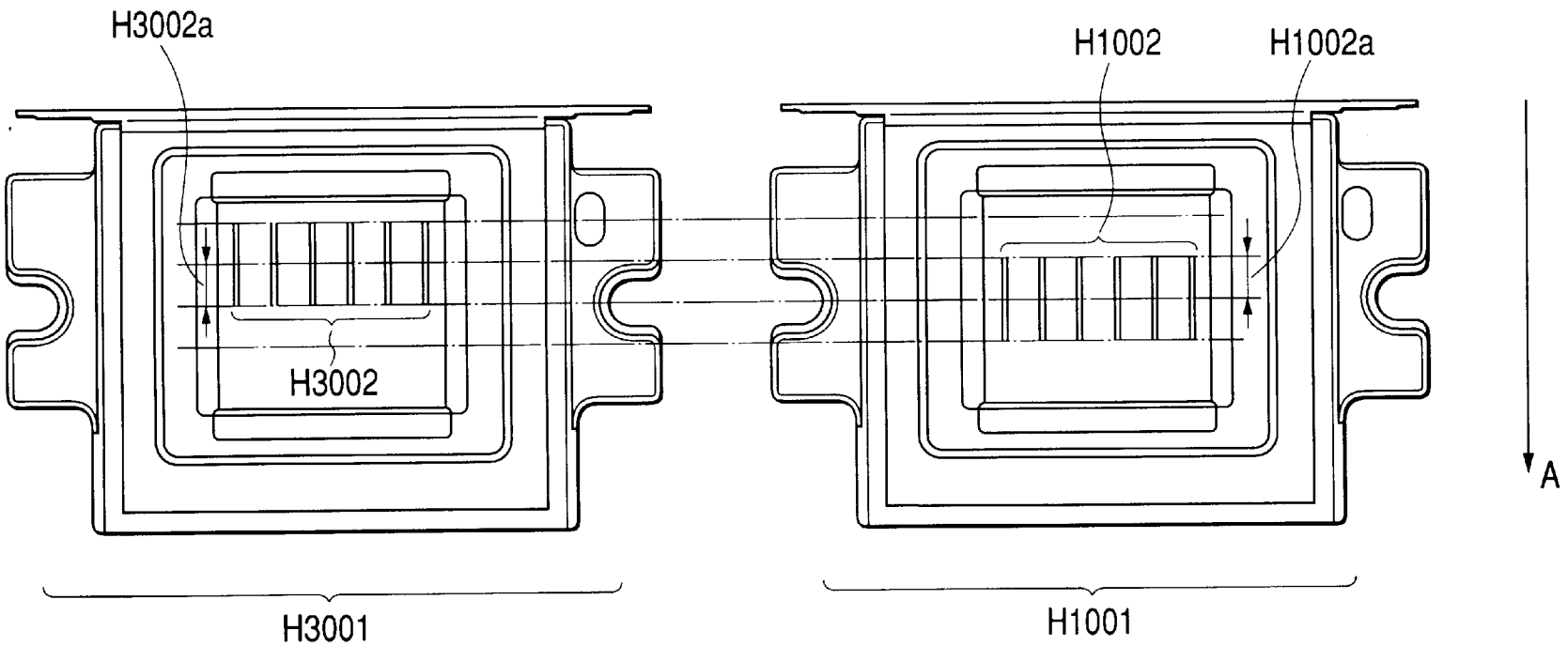
FIG. 17 is a schematic diagram for showing a positional relationship of nozzles between the recording head shown in FIGS. 10 to 12 and a recording head different therefrom in nozzle position.

FIG. 17 is a schematic diagram for showing a positional relationship of nozzles between the above-mentioned recording head H1001 and a recording head which has the same nozzle length as this recording head H1001 but has a different position of a nozzle used in top-and-bottom blank-less recording. In FIG. 17, an arrow A indicates a direction in which a recording sheet is conveyed.

In FIG. 17, the recording heads H1001 and H3001 have the same nozzle length. A half nozzle array H 3002*a* on the downstream side of a nozzle array H3002 of the recording head H3001 corresponds to the half nozzle array H1002*a* on the upstream side of the nozzle array H1002 of the recording head H1001 and is used in top-and-bottom blank-less recording.

The following will describe recording operations when this recording head H3001 is used.

Figure 18:
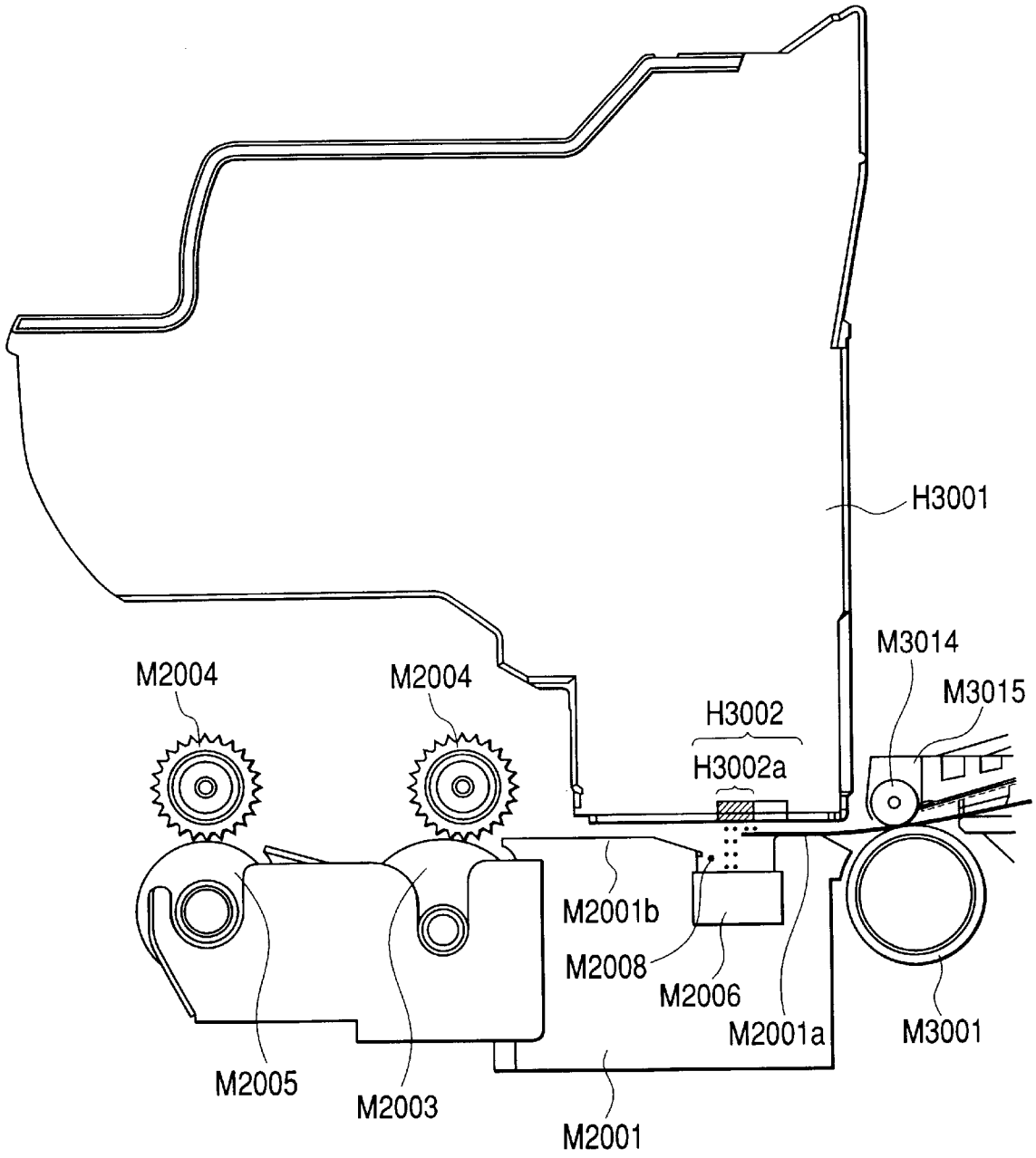
FIG. 18 is a schematic diagram for explaining recording at the top of the recording sheet when the recording head having the different nozzle position shown in FIG. 17 is used.
Figure 19:
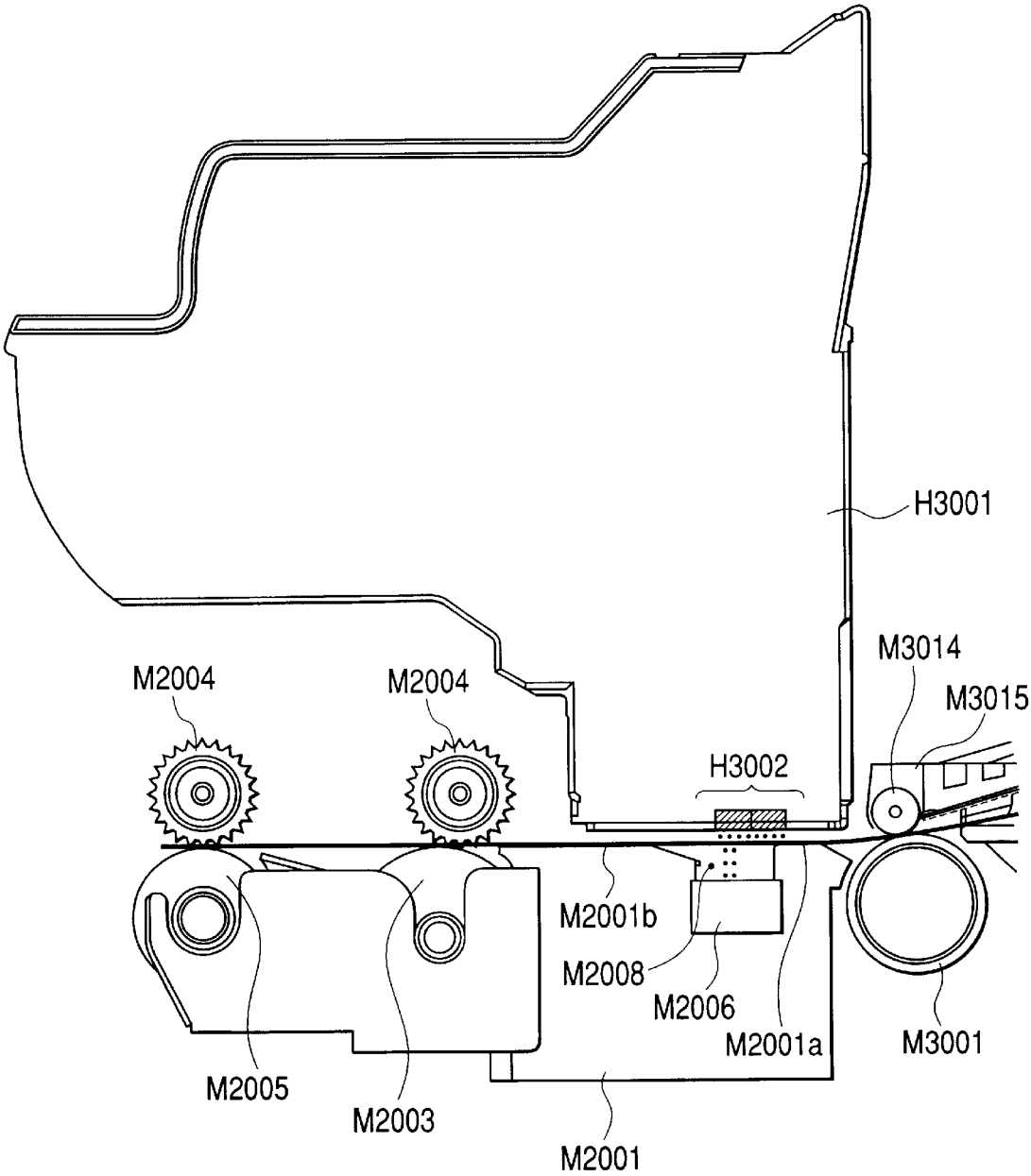
FIG. 19 is a schematic diagram for explaining recording at the middle of the recording sheet when the recording head having the different nozzle position shown in FIG. 17 is used.
Figure 20:
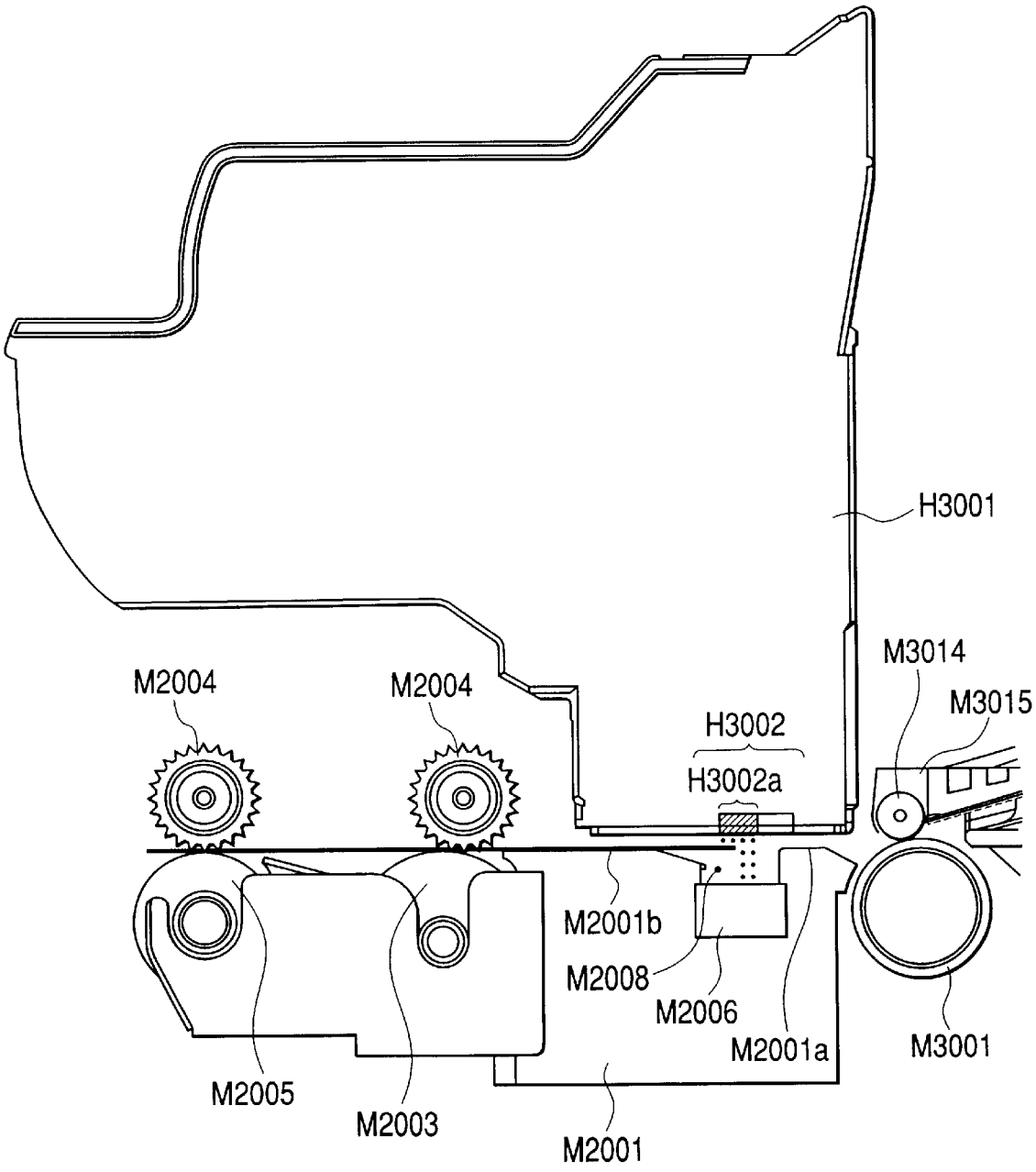
FIG. 20 is a schematic diagram for explaining recording at the bottom of the recording sheet when the recording head having the different nozzle position shown in FIG. 17 is used.
Figure 21:
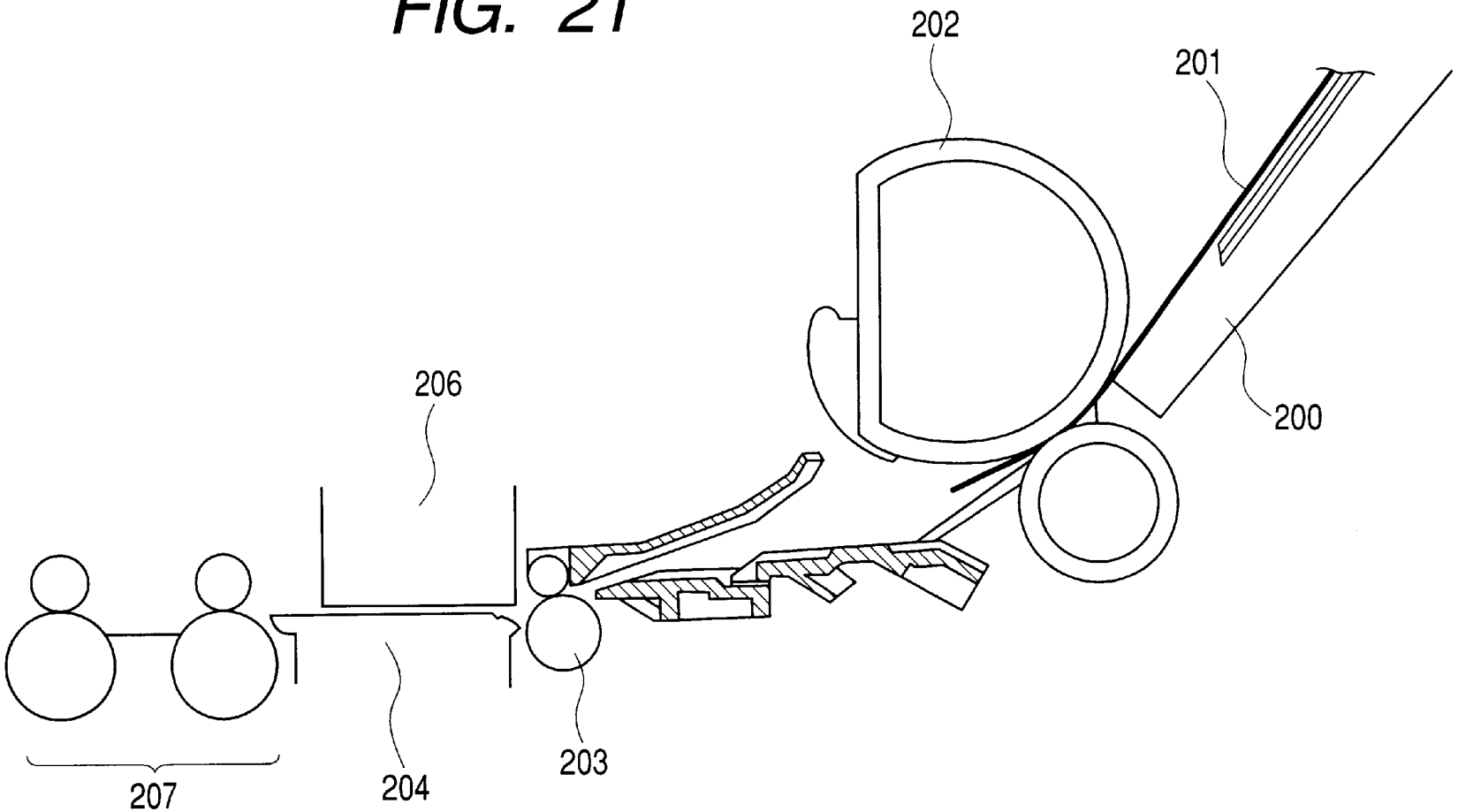
FIG. 21 is a configuration diagram for outlining a typical ink jet recording apparatus.

FIGS. 18 to 20 explain the top-and-bottom blank-less recording operation by use of the recording head shown in FIG. 17, of which, FIG. 18 is a schematic diagram for explaining recording at the top of the recording, FIG. 19 is a schematic diagram for explaining recording at the middle of the recording sheet, and FIG. 20 is a schematic diagram for explaining recording at the bottom of the recording.

The recording sheet P fed out by the automatic feeding section M3022 and conveyed by the conveying section M3029 as having its position regulated by the recording sheet support face M2001*a* of the platen M2001 undergoes recording at its top using the nozzle array H3002*a* of the nozzle array H3002 of the recording head H3001, that is top blank-less recording as shown in FIG. 18. In this case, the conveying amount (feed amount) of the recording sheet P corresponds to the nozzle length of the nozzle array H3002*a*.

In this top blank-less recording operation, such part of the ink ejected out of the nozzle array H3002*a* as to have been deflected from the recording sheet P (that is, from the top of the recording sheet P) is guided through the preliminary ejection outlet M2008 to be absorbed and held by the platen absorber M2016 provided in the preliminary ejection outlet M2008.

When the recording on the recording sheet P by means of the recording head H3001 advances up to its top completely, subsequently, as shown in FIG. 19, the process takes another step to use all the nozzles of the nozzle array H3002 of the recording head H3001 and also increases the conveying amount (feed amount) of the recording sheet P to such a value as to match the overall nozzle length of the nozzle array H3002, thus recording data at the middle of the recording sheet P. In this case, the position of the recording sheet P is regulated by the recording sheet support faces M2001*a* and M2001*b*.

In this case of recording at the middle, the number of the nozzles used in recording is twice the number in the case of top blank-less recording, accompanied by an increase in the conveying amount (feed amount) of the recording sheet P as well. Accordingly, recording at the middle of the recording sheet P can be performed faster than top blank-less recording.

When the recording onto the recording sheet P by means of the recording head H3001 further advances up to its middle completely, subsequently the recording head H2001 shifts to bottom blank-less recording of the recording sheet P as shown in FIG. 20. In this case of bottom blank-less recording, the nozzle array H3002*a* of the nozzle array H3002 is used again, to record the data at the bottom of the recording sheet P after the recording sheet P is fed by a conveying amount (feed amount) that matches the nozzle length of the nozzle H3002*a*.

As in the case of the above-mentioned top blank-less recording operation, in the case of this bottom blank-less recording operation also, such part of the ink ejected out of the nozzle array H3002*a* as to have been deflected out from the recording sheet P (from the bottom of the recording sheet P) is guided through the preliminary ejection outlet M2008 to be absorbed and held by the platen absorber M2016 provided in the preliminary ejection outlet M2008.

The above-mentioned series of recording operations enables top-and-bottom blank-less recording without contaminating the platen M2001 and the recording sheet P.

As described above, in the case of the recording head H3001 different in nozzle length from the recording head H1001, by using nozzles at the same position (in this case, the nozzles H1002*a* and H3002*a*) in the recording sheet conveying direction, it is possible to perform top-and-bottom blank-less recording without changing the position of the preliminary ejection outlet M2008 on the side of the platen M2001. It is thus possible to use the same platen M2001 even with the recording heads having different nozzle lengths. It is, therefore, possible to use the platen and the ink absorber as common parts of the various recording heads, thus reducing manufacturing costs owing to an effect of the common utilization of the parts.

Note here that preferably the preliminary ejection outlet M2008 is so sized as to guide the ink ejected out of all the nozzles of the nozzle array H1002 of the recording head H1001 or the nozzle array H3002 of the recording head H3001 at a position near both edges of the various sizes of fixed-type forms (for example, LTR size, A4 size, L size, 2L size, 4"×6" size of forms). By providing such a configuration, as in the above-mentioned case of top-and-bottom blank-less recording on a recording sheet, in the case of right-and-left-edge blank-less recording on the recording sheet, the ink deflected out from the recording sheet P (deflected from the bottom of the recording sheet P) can be guided through the preliminary ejection outlet M2008 to be absorbed and held by the platen absorber M2016. As a result, four-edge blank-less recording can be performed with the recording heads with different nozzle lengths without changing the configuration of the platen M2001.

The configurations given in the above-mentioned embodiments provide just one aspect of the ink jet printer according to the present invention and so the present invention is not limited thereto. For example, the length and position of the recording head and the position and size of the preliminary ejection outlet of the platen can be changed properly corresponding to a design.

As explained above, according to the present embodiment, the preliminary ejection outlet provided on the platen side can be commonly used for various recording heads having different nozzle lengths and positions, thus reducing manufacturing costs owing to the common utilization of the platen parts.

In addition, according to the present embodiment, the size of the preliminary ejection outlet is small enough to preserve a reference face of the platen sufficiently and also to prevent paper jamming from occurring. It is, therefore, possible to provide an ink jet printer capable of blank-less recording which is low in running cost and high in recording quality.

What is claimed is:

1. An ink jet recording apparatus comprising:

head mounting means for mounting a first recording head having a nozzle row in which a plurality of nozzles are arranged in a predetermined direction to eject out ink from at least some of said nozzles of said nozzle row in order to perform recording on a recording sheet conveyed in said predetermined direction; and a platen arranged opposite to said head mounting means, for regulating a position of said recording sheet, wherein said first recording head can be replaced by a second recording head which is different therefrom in position or length of said nozzle row in said predetermined direction, and said platen has a preliminary ejection outlet common in use to said first and second recording heads, for guiding the ink ejected out from some of said nozzles of said nozzle row.

2. An ink jet recording apparatus according to claim 1, wherein said first and second recording heads each have said nozzle row divided into a plurality of nozzle regions in said predetermined direction in such a configuration that at least one of said plurality of nozzle regions is disposed opposite to said preliminary ejection outlet.

3. An ink jet recording apparatus according to claim 2, comprising control means for controlling recording on the recording sheet, said control means using only said nozzle region disposed opposite to said preliminary ejection outlet of said plurality of nozzle regions to perform recording at a top and a bottom of said recording sheet and using all of said plurality of nozzle regions to perform recording at the other parts of said recording sheet.

4. An ink jet recording apparatus according to claim 1, wherein said platen has a first reference face and a second reference face on an upstream side and a downstream side of said preliminary ejection outlet respectively in a conveying direction of the recording sheet, at least one of said first and second reference faces being used to regulate the position of said recording sheet.

5. An ink jet recording apparatus according to claim 4, wherein said first and second reference faces are provided adjacent said preliminary ejection outlet.

6. An ink jet recording apparatus according to claim 1, wherein an ink absorbing member for absorbing the ink is provided in said preliminary ejection outlet.

7. An ink jet recording apparatus according to claim 1, wherein said recording sheet is a regular-type form having a predetermined size, and said preliminary ejection outlet has such a configuration that a portion thereof that corresponds to a position of a width-directional edge of said fixed-type form may guide the ink ejected out from all of said nozzles of said nozzle row.

* * * * *